US006401688B2

(12) United States Patent
Teraji et al.

(10) Patent No.: US 6,401,688 B2
(45) Date of Patent: Jun. 11, 2002

(54) AUTO-IGNITION COMBUSTION MANAGEMENT IN INTERNAL COMBUSTION ENGINE

(75) Inventors: Atushi Teraji, Yokohama; Ken Naitoh, Yamagata; Koudai Yoshizawa, Kanagawa; Eiji Aochi, Yokohama, all of (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/769,365

(22) Filed: Jan. 26, 2001

(30) Foreign Application Priority Data

Jan. 27, 2000 (JP) ..... 2000-018856
Jan. 27, 2000 (JP) ..... 2000-018898

(51) Int. Cl.[7] ..... F02B 3/10
(52) U.S. Cl. ..... 123/295; 123/299
(58) Field of Search ..... 123/295, 299

(56) References Cited

U.S. PATENT DOCUMENTS 4,284,043 A * 8/1981 Happel ..... 123/299
4,370,958 A * 2/1983 Pischinger et al. ..... 123/299
4,414,940 A * 11/1983 Loyd ..... 123/299
5,271,362 A * 12/1993 Kobayashi et al. ..... 123/299
5,697,332 A 12/1997 Asai et al. ..... 123/65 PE
5,727,519 A * 3/1998 Kawamura ..... 123/299
6,062,189 A * 5/2000 Kaneko et al. ..... 123/295
6,202,601 B1 * 3/2001 Ouellette et al. ..... 123/299
6,182,632 B1 * 2/2002 Yanagahira et al. ..... 123/299

FOREIGN PATENT DOCUMENTS

JP 7-71279 3/1995
JP 10-196424 7/1998
JP 11-236848 8/1999

* cited by examiner

*Primary Examiner*—Erick Solis
(74) *Attorney, Agent, or Firm*—Foley & Lardner

(57) ABSTRACT

An enhanced auto-ignition in a gasoline internal combustion engine, comprises a fuel injector directly communicating with said combustion chamber for spraying gasoline fuel. The fuel injector sprays a first injection quantity of gasoline fuel into a combustion chamber at first fuel injection timing, which falls in a range from the intake stroke to the first half of the compression stroke, thereby to form air/fuel mixture cloud that becomes a body of mixture as the engine piston moves from the first fuel injection timing toward a top dead center position of the compression stroke, and the fuel injector sprays a second injection quantity of gasoline fuel into the body of mixture at second fuel injection timing, which falls in the second half of the compression stroke, forming mixture cloud that is superimposed on a portion of said body of mixture, thereby to establish the cylinder content wherein the density of fuel particles within the superimposed portion is high enough to burn by auto-ignition at an ignition point in the neighborhood of the piston top dead center position of the compression stroke, causing temperature rise and pressure, which initiate auto-ignition of the fuel particles within the remaining portion of said body of mixture.

27 Claims, 18 Drawing Sheets

30
32
18
18
18
18
10
36
VEHICLE ACCELERTOR PEDAL
40
42
INPUT PORTS
SENSORS
34
56
SPARK PLUGS
52
RAM
50
ROM
54
KAM
48
46
OUTPUT PORTS
58
MPU
44
LU
60

AUTO-IGNITION COMBUSTION MANAGEMENT IN INTERNAL COMBUSTION ENGINE

BACKGROUND OF THE INVENTION

1. Field of the Invention

The present invention relates to a system or method for enhanced auto-ignition in a gasoline internal combustion engine.

2. Description of Related Art

To improve thermal efficiency of gasoline internal combustion engines, lean burn is known to give enhanced thermal efficiency by reducing pumping losses and increasing ratio of specific heats. Flatly speaking, lean burn is known to give low fuel consumption and low NOx emissions. There is however a limit at which an engine can be operated with a lean air/fuel mixture because of misfire and combustion instability as a result of a slow burn. Known methods to extend the lean limit include improving ignitability of the mixture by enhancing the fuel preparation, for example using atomized fuel or vaporized fuel, and increasing the flame speed by introducing charge motion and turbulence in the air/fuel mixture. Finally, combustion by auto-ignition has been proposed for operating an engine with very lean air/fuel mixtures.

When certain conditions are met within a homogeneous charge of lean air/fuel mixture during low load operation, auto-ignition can occur wherein bulk combustion takes place initiated simultaneously from many ignition sites within the charge, resulting in very stable power output, very clean combustion and high thermal efficiency. NOx emission produced in controlled auto-ignition combustion is extremely low in comparison with spark ignition combustion based on propagating flame front and heterogeneous charge compression ignition combustion based on an attached diffusion flame. In the latter two cases represented by spark ignition engine and diesel engine, respectively, the burnt gas temperature is highly heterogeneous within the, charge with very high local temperature values creating high NOx emission. By contrast, in controlled auto-ignition combustion where the combustion is uniformly distributed throughout the charge from many ignition sites, the burnt gas temperature is substantially homogeneous with much lower local temperature values resulting in very low NOx emission.

Engines operating under controlled auto-ignition combustion have already been successfully demonstrated in two-stroke gasoline engines using a conventional compression ratio. U.S. Pat. No. 5,697,332 (=JP-A 7-71279) teaches an exhaust control valve to regulate the pressure in a cylinder during ascending stroke of a piston to achieve auto-ignition combustion of a two-stroke engine at optimum timing. It is believed that the high proportion of burnt gases remaining from the previous cycle, i.e., the residual content, within the engine combustion chamber is responsible for providing the hot charge temperature and active fuel radicals necessary to promote auto-ignition in a very lean air/fuel mixture. Besides, combustion temperature is low due to lean burn, causing a considerable reduction NOx emission. In four-stroke engines, because the residual content is low, auto-ignition is more difficult to achieve, but can be induced by heating the intake air to a high temperature or by significantly increasing the compression ratio.

In all the above cases, the range of engine speeds and loads in which controlled auto-ignition combustion can be achieved is relatively narrow. The fuel used also has a significant effect on the operating range, for example, diesel fuel and methanol fuel have wider auto-ignition ranges than gasoline fuel.

JP-A 11-236848 teaches a first fuel injection at a crank position more than 30 degrees before top dead center (TDC) position of compression stroke and a second fuel injection at a crank position near the TDC position to achieve controlled auto-ignition combustion in a diesel internal combustion engine. At the crank position of the first fuel injection, the temperature in the cylinder is still relatively low so that diesel fuel sprayed as the first fuel injection is not burnt but converted into flammable oxygen containing hydrocarbon due to low temperature oxidation reaction (partial oxidation of hydrocarbon molecules). At the crank position of the second fuel injection near the TDC of compression stroke, the temperature in the cylinder is sufficiently high enough to pyrolyze the gasoline sprayed as the second fuel injection, causing the gasoline to diffuse to make hydrogen due to pyrolysis. The hydrogen burns to elevate the temperature within the cylinder. This temperature elevation causes auto-ignition of flammable oxygen containing hydrocarbon (sprayed gasoline of the first fuel injection). This combustion promotes combustion of the sprayed gasoline of the second fuel injection.

According to this known technique, the injection quantity at the first fuel injection is held below 30% of the maximum injection quantity. Specifically, the injection quantity at the first fuel injection ranges from 10% to 20% of the maximum injection quantity. If the injection quantity at the first fuel injection exceeds 30% of the maximum fuel injection quantity, there occur fuel particles that are heated above the pyrolysis temperature by heat generated during low temperature oxidation reaction of the surrounding fuel., and hydrogen made due to the pyrolysis burns to cause early burn of sprayed gasoline at the first fuel injection. This accounts for why the injection quantity at the first fuel injection is held below 30% of the maximum injection quantity.

Apparently, this technique is intended for use in diesel internal combustion engines. Applying this technique to an auto-ignition gasoline internal combustion engine would pose the following problem.

It is now assumed that the total fuel quantity required per cycle is 60% of the maximum fuel injection quantity. In this case, spraying fuel as much as 10% of the maximum injection quantity at the first fuel injection timing will require spraying fuel as much as 50% of the maximum fuel quantity at the second fuel injection timing. As compared to diesel fuel, it is widely recognized that gasoline fuel is less ignitable, slow in reaction speed of cold temperature oxidation reaction, and least subject to pyrolysis including changes to make hydrogen. Accordingly, the fuel sprayed at the second fuel injection timing will not burn quickly. This sprayed fuel forms fuel rich mixture within a limited region of the combustion chamber, and this fuel rich mixture will burn simultaneously by auto-ignition after low temperature oxidation reaction. Under this combustion condition, increasing fuel quantity of the second injection may cause excessive pressure increase in cylinder and/or increased production of NOx.

JP-A 10-196424 teaches admission of ignition oil to achieve auto-ignition of mixture at or near TDC position of compression stroke. If, as the ignition oil, ignitable fuel is used other than gasoline fuel, dual fuel delivery systems are needed, resulting in increased complexity.

An object of the present invention is to provide a system or method for enhanced auto-ignition in an internal combustion engine.

SUMMARY OF THE INVENTION

In carrying out the present invention, a gasoline internal combustion engine is provided. The engine comprises:

a cylinder;

a reciprocating piston disposed in said cylinder to define a combustion chamber therein to perform an intake stroke, a compression stroke, an expansion stroke, and an exhaust stroke; and a fuel injector directly communicating with said combustion chamber for spraying gasoline fuel, a control arrangement being such that said fuel injector sprays a first injection quantity of gasoline fuel into said combustion chamber at first fuel injection timing, which falls in a range from the intake stroke to the first half of the compression stroke, thereby to form air/fuel mixture cloud that becomes a body of mixture as said piston moves from said first fuel injection timing toward a top dead center position of the compression stroke, and such that said fuel injector sprays a second injection quantity of gasoline fuel into said body of mixture at second fuel injection timing, which falls in the second half of the compression stroke, forming mixture cloud that is superimposed on a portion of said body of mixture, thereby to establish the cylinder content wherein the density of fuel particles within said superimposed portion is high enough to burn by auto-ignition at an ignition point in the neighborhood of the piston top dead center position of the compression stroke, causing temperature rise and pressure, which initiate auto-ignition of the fuel particles within the remaining portion of said body of mixture.

In carrying out the present invention, a system for enhanced auto-ignition management in an internal combustion engine is provided. The system comprises:

a cylinder having a cylinder axis thereof;

a cylinder head closing said cylinder;

a reciprocating piston within said cylinder, said piston, said cylinder and said cylinder head cooperating with each other to define a combustion chamber;

intake and exhaust valves for admitting fresh air into said combustion chamber and for discharging exhaust gas from said combustion chamber, respectively;

a fuel injector mounted to said cylinder head for spraying gasoline fuel into said combustion chamber, said fuel injector having a hollow cone nozzle with a spout communicating with said combustion chamber, said hollow cone nozzle imparting torque to gasoline fuel passing through said spout, causing the fuel to generate swirl around a nozzle axis, promoting the fuel to spread outwardly along a cone surface of an imaginary circular cone, said imaginary circular cone being a solid cone bounded by a region enclosed in a circle and a cone surface that is formed by the segments joining each point on said circle to a point outside of said region and on said nozzle axis within said spout;

said piston moving along said cylinder axis toward and away from said cylinder head to perform an intake stroke, a compression stroke, an expansion stroke, and an exhaust stroke in cooperation with said intake and exhaust valves; and a control unit being operative to establish an engine load threshold and an engine speed threshold;

said control unit being operative to compare the engine load with said engine load threshold, said control unit being operative to compare the engine speed with said engine speed threshold, said control unit being operative to enable split fuel injection for auto-ignition combustion in response to the comparing result of the engine load with said engine load threshold and the comparing result of the engine speed with said engine speed threshold, said control unit being operative to determine a ratio in response to the engine load, said control unit being operative to determine total fuel injection quantity in response to the engine load, said control unit being operative to divide said total fuel injection quantity at said determined ratio into injection quantity for first fuel injection and into injection quantity for second fuel injection, said control unit being operative to determine a first injection timing that falls in a range from the intake stroke to the termination of the first half of compression stroke, said control unit being operative to determine a second injection timing that falls in the second half of the compression stroke, said control unit being operative to determine a first pulse width corresponding to the injection quantity for the first fuel injection and a second pulse width corresponding to the injection quantity for the second fuel injection, said control unit being operative to apply a first fuel injection control signal with said first pulse width, at said first injection timing, to said fuel injector, causing said fuel injector to spray said first injection quantity of gasoline fuel into said combustion chamber, thereby to form a conical ring shaped air/fuel mixture cloud that becomes a circular solid body of mixture as said piston moves from said first injection timing toward a top dead center position of the compression stroke, said control unit being operative to apply a second fuel injection control signal with said second pulse width, at said second injection timing, to said fuel injector, causing said fuel injector to spray said second injection quantity of gasoline fuel into said circular solid body of mixture, thereby to form, within said circular solid body of mixture, a ring shaped mixture cloud that is superimposed on a portion of said circular solid body of mixture, thereby to establish the cylinder content wherein the density of fuel particles within said superimposed portion is high enough to burn by auto-ignition at an ignition point in the neighborhood of the piston top dead center position of the compression stroke, causing temperature rise and pressure rise, which initiate auto-ignition of the fuel particles within the remaining portion of said circular body of mixture.

In carrying out the present invention, a system for enhanced auto-ignition management in an internal combustion engine is provided, The system comprises:

a cylinder having a cylinder axis thereof;

a cylinder head closing said cylinder;

a reciprocating piston within said cylinder, said piston, said cylinder and said cylinder head cooperating with each other to define a combustion chamber;

intake and exhaust valves for admitting fresh air into said combustion chamber and for discharging exhaust gas from said combustion chamber, respectively;

a fuel injector mounted to said cylinder head and having a nozzle with a spout communicating with said combustion chamber for spraying gasoline fuel into said combustion chamber;

said piston moving along said cylinder axis toward and away from said cylinder head to perform an intake stroke, a compression stroke, an expansion stroke, and an exhaust stroke in cooperation with said intake and exhaust valves; and a control unit being operative to establish an engine load threshold and an engine speed threshold;

said control unit being operative to compare the engine load with said engine load threshold, said control unit being operative to compare the engine speed with said engine speed threshold, said control unit being operative to enable split fuel injection for auto-ignition combustion in response to the comparing result of the engine load with said engine load threshold and the comparing result of the engine speed with said engine speed threshold, said control unit being operative to determine a ratio in response to the engine load, said control unit being operative to determine total fuel injection quantity in response to the engine load, said control unit being operative to divide said total fuel injection quantity at said determined ratio into injection quantity for first fuel injection and into injection quantity for second fuel injection, said control unit being operative to determine a first injection timing in response to said engine load such that said first injection timing retards in a direction from the bottom dead center position of the compression stroke to the top dead center position of the compression stroke as the engine load decreases, said control unit being operative to determine a second injection timing that falls in the second half of the compression stroke, said second injection timing being always nearer the top dead center position of the compression stroke than said first injection timing, said control unit being operative to determine a first pulse width corresponding to the injection quantity for the first fuel injection and a second pulse width corresponding to the injection quantity for the second fuel injection, said control unit being operative to apply a first fuel injection control signal with said first pulse width, at said first injection timing, to said fuel injector, causing said fuel injector to spray said first injection quantity of gasoline fuel into said combustion chamber, thereby to form an air/fuel mixture cloud that becomes a solid body of mixture in the vicinity of said cylinder axis as said piston moves from said first injection timing toward the top dead center position of the compression stroke, said control unit being operative to apply a second fuel injection control signal with said pulse width, at said second injection timing, to said fuel injector, causing said fuel injector to spray said second injection quantity of gasoline fuel into said solid body of mixture, forming, within said solid body of mixture, a mixture cloud that is superimposed on a portion of said solid body of mixture, thereby to establish the cylinder content wherein the density of fuel particles of said superimposed portion is high enough to burn by auto-ignition at an ignition point in the neighborhood of the piston top dead center position of the compression stroke, causing temperature rise and pressure rise, which initiate auto-ignition of the fuel particles within the remaining portion of said circular body of mixture.

In carrying out the present invention, there is provided a method of controlling split gasoline fuel injection for enhanced auto-ignition management in an internal combustion engine, the engine having a cylinder with a cylinder axis thereof; a cylinder head closing the cylinder; a reciprocating piston within the cylinder to define a combustion chamber to perform an intake stroke, a compression stroke, an expansion stroke, and an exhaust stroke; intake and exhaust valves for admitting fresh air into the combustion chamber and for discharging exhaust gas from the combustion chamber, respectively; and a fuel injector for spraying gasoline fuel into the combustion chamber, the fuel injector having a hollow cone nozzle with a spout communicating with the combustion chamber, the hollow cone nozzle imparting torque to gasoline fuel passing through the spout, causing the fuel to generate swirl around a spout axis that aligns the cylinder axis, promoting the fuel to spread outwardly along a cone surface of an imaginary circular cone, the imaginary circular cone being a solid cone bounded by a region enclosed in a circle about the cylinder axis and a cone surface that is formed by the segments joining each point on the circle to a point outside of the region and on the nozzle axis within the spout, said method comprising:

establishing an engine load threshold;

establishing an engine speed threshold;

comparing the engine load with said engine load threshold;

comparing the engine speed with said engine speed threshold;

enabling split fuel injection for auto-ignition combustion in response to the comparing result of the engine load with said engine load threshold and the comparing result of the engine speed with said engine speed threshold;

determining a ratio in response to the engine load;

determine total fuel injection quantity in response to the engine load;

dividing said total fuel injection quantity at said determined ratio into injection quantity for first fuel injection and into injection quantity for second fuel injection, determining a first injection timing that falls in a range from the piston intake stroke to the end of the first half of the piston compression stroke;

determining a second injection timing that falls in the second half of the piston compression stroke;

determine a first pulse width corresponding to the injection quantity for the first fuel injection;

determining a second pulse width corresponding to the injection quantity for the second fuel injection;

applying a first fuel injection control signal with said first pulse width at said first injection timing to said fuel injector, causing said fuel injector to spray said first injection quantity of gasoline fuel into said combustion chamber, thereby to form a conical ring shaped air/fuel mixture cloud that becomes a circular solid body of mixture as said piston moves from said first injection timing toward a top dead center position of the compression stroke;

applying a second fuel injection control signal with said second pulse width at said second injection timing to said fuel injector, causing said fuel injector to spray said second injection quantity of gasoline fuel into said circular solid body of mixture, forming, within said circular solid body of mixture, a ring shaped mixture cloud that is superimposed on a portion of said circular solid body of mixture, thereby to establish the cylinder content wherein the density of fuel particles within said superimposed portion is high enough to burn by auto-ignition at an ignition point in the neighborhood of the piston top dead center position of the compression stroke, causing temperature rise and pressure rise, which initiate auto-ignition of the fuel particles within the remaining portion of said circular body of mixture.

In carrying out the present invention, there is provided a method of controlling gasoline fuel injection for enhanced auto-ignition management in an internal combustion engine, the engine having a cylinder with a cylinder axis thereof; a cylinder head closing the cylinder; a reciprocating piston within the cylinder to define a combustion chamber to perform an intake stroke, a compression stroke, an expansion stroke, and an exhaust stroke; intake and exhaust valves for admitting fresh air into the combustion chamber and for discharging exhaust gas from the combustion chamber, respectively; and a fuel injector having a nozzle with a spout communicating with the combustion chamber for spraying gasoline fuel into the combustion chamber, said method comprising:

determining a ratio in response to the engine load;

determine total fuel injection quantity in response to the engine load;

dividing said total fuel injection quantity at said determined ratio into injection quantity for first fuel injection and into injection quantity for second fuel injection;

determining a first injection timing in response to the engine load such that said first injection timing retards in a direction from the bottom dead center position of the compression stroke to the top dead center position of the compression stroke as the engine load decreases;

determining a second injection timing that falls in the second half of the compression stroke, said second injection timing being always nearer the top dead center position of the compression stroke than said first injection timing is;

determine a first pulse width corresponding to the injection quantity for the first fuel injection;

determining a second pulse width corresponding to the injection quantity for the second fuel injection;

applying a first fuel injection control signal with said first pulse width at said first injection timing to the fuel injector, causing the fuel injector to spray said first injection quantity of gasoline fuel into the combustion chamber, thereby to form an air/fuel mixture cloud that becomes a body of mixture in the vicinity of said cylinder axis as said piston moves from said first injection timing toward the top dead center position of the compression stroke, applying a second fuel injection control signal with said second pulse width at said second injection timing to the fuel injector, causing the fuel injector to spray said second injection quantity of gasoline fuel into said body of mixture, forming, within said body of mixture, a mixture cloud that is superimposed on a portion of said solid body of mixture, fuel particles sprayed at said first fuel injection timing and fuel particles sprayed at said second fuel injection timing coexisting within said superimposed portion, thereby to establish the cylinder content wherein the density of fuel particles of said superimposed portion is high enough to burn by auto-ignition at an ignition point in the neighborhood of the piston top dead center position of the compression stroke, causing temperature rise and pressure rise, which initiate auto-ignition of the fuel particles within the remaining portion of said circular body of mixture.

In carrying out the present invention, there is provided a computer readable storage medium having stored therein data representing instructions executable by an engine control unit to control split gasoline fuel injection for enhanced auto-ignition, the computer readable storage medium comprising:

instructions for establishing an engine speed threshold;

instructions for establishing an engine load threshold;

instructions for comparing the engine speed with said engine speed threshold;

instructions for comparing the engine load with said engine load threshold;

instruction for enabling or disabling split gasoline fuel injection control;

instructions for determining a ratio in response to the engine load;

instructions for determine total fuel injection quantity in response to the engine load;

instructions for dividing said total fuel injection quantity at said determined ratio into injection quantity for first fuel injection and into injection quantity for second fuel injection;

instructions for determining injection timing for first fuel injection; and instructions for determining injection timing for second fuel injection.

BEST MODES FOR CARRYING OUT THE INVENTION

Figure 3:
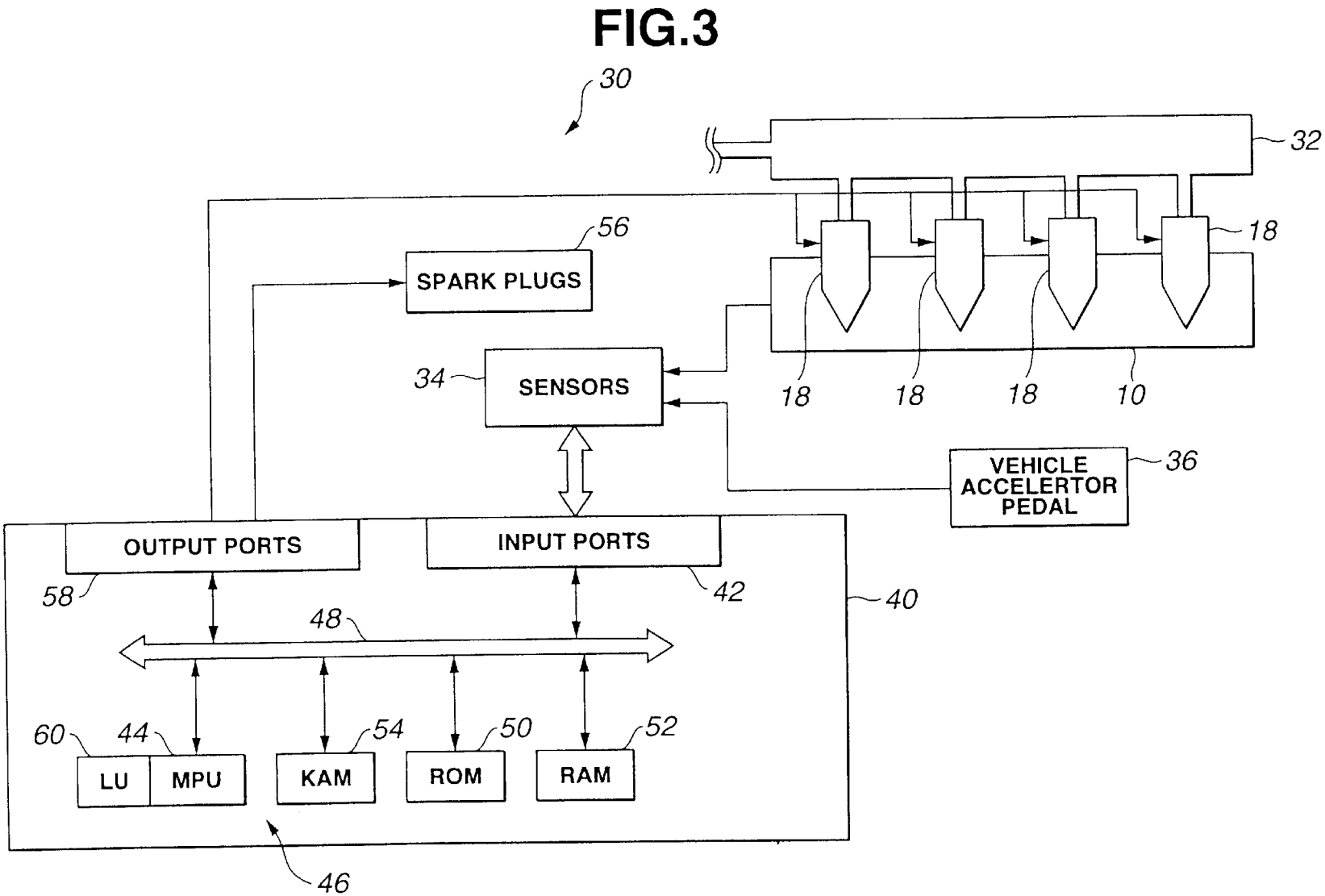
FIG. 3 is a schematic diagram illustrating the system for enhanced auto-ignition management made in accordance with the present invention.

Referring now to FIG. 3, a system for enhanced auto-ignition in a gasoline internal combustion engine is shown. The system, generally indicated by reference numeral 30, includes an engine 10 having a plurality of cylinders each fed by fuel injectors 18. The fuel injectors 18 are shown receiving pressurized gasoline fuel from a supply 32 which is connected to one or more high or low pressure pumps (not shown) as is well known in the art. Alternatively, embodiments of the present invention may employ a plurality of unit pumps (not shown), each pump supplying fuel to gasoline fuel to one of the injectors 18.

Figure 1:
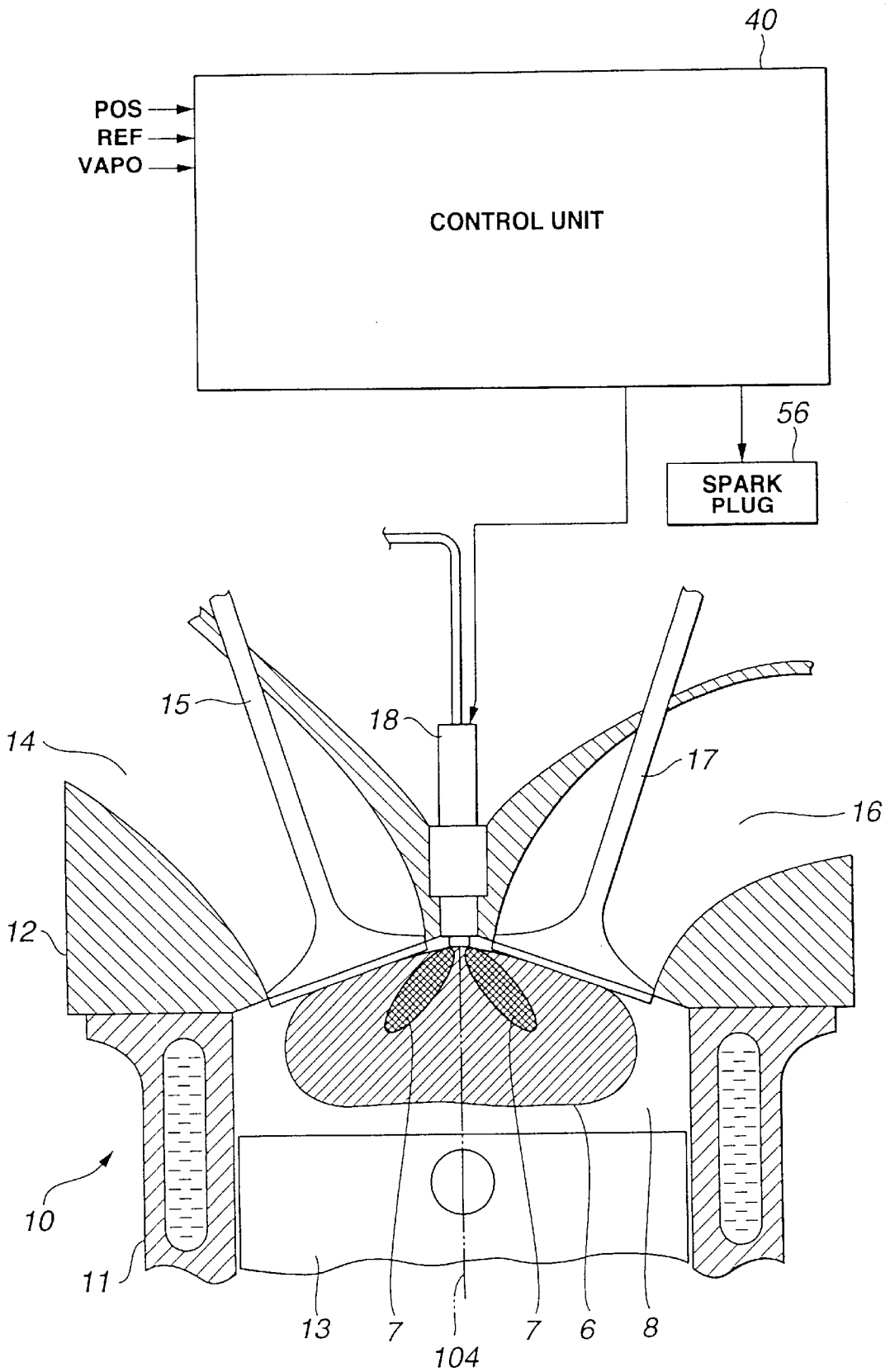
FIG. 1 is a schematic diagram of the cylinder content established in an internal combustion engine by a system for enhanced auto-ignition management made in accordance with the present invention.
Figure 2:
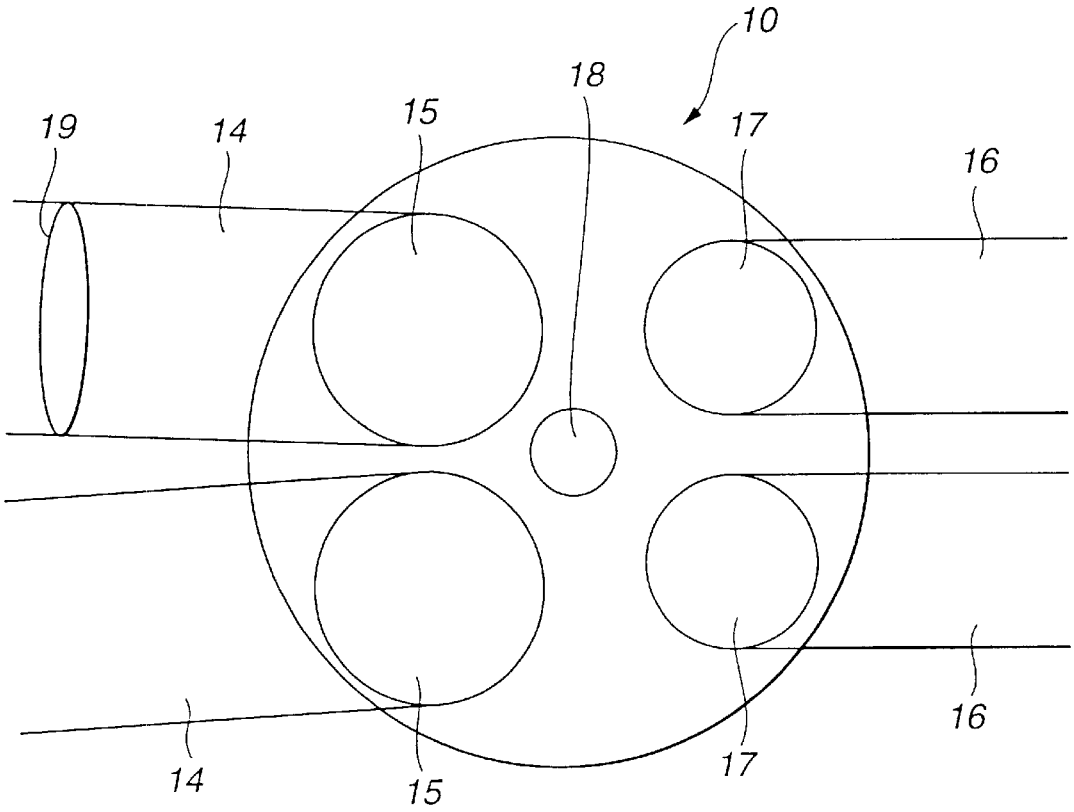
FIG. 2 is a schematic diagram illustrating a combustion chamber provided with two intake ports and two exhaust ports.

Referring also to FIGS. 1 and 2, in a preferred embodiment, engine 10 is a four-stroke cycle internal combustion engine capable of running under auto-ignition combustion of gasoline fuel and under spark-ignition combustion of gasoline fuel as well. The engine 10 includes a cylinder block 11 formed with a plurality of cylinders, only one being shown. A cylinder head 12 is attached to cylinder block 11 and closes the cylinders. As illustrated, each cylinder receives a reciprocating piston 13. The piston 13, cylinder and cylinder head 12 cooperate with each other to define a combustion chamber. The cylinder head 12 has two intake ports 14 and two exhaust ports 16 communicating with the combustion chamber. Intake and exhaust valves 15 and 17 are provided for admitting fresh air into the combustion chamber and for discharging exhaust gas from the combustion chamber, respectively. Two intake valves 15 close the two intake ports 14, respectively. Two exhaust valves 17 close the exhaust ports 16, respectively. In the gas exchange system shown in FIG. 2, a swirl control valve 19 is provided to open or close one of the intake ports 14, and the other port is configured as a swirl port. The operation of the swirl control valve 19 is such that, when the swirl control valve 19 is closed, fresh air is admitted into the combustion chamber after passing through the swirl port 14 only to generate swirl in the cylinder. Opening the swirl control valve 19 will admit fresh air to the combustion chamber without generation of swirl in the cylinder. Alternatively, embodiments of the present invention may not employ the swirl generation gas exchange system including the swirl port and the swirl control valve. The fuel injectors 18 are mounted to the cylinder head 12, each spraying gasoline fuel into the combustion chamber in one of the cylinders. In this preferred embodiment, each of the fuel injectors 18 has a hollow cone nozzle with a spout communicating with the combustion chamber. The hollow cone nozzle is later described in connection with FIG. 8.

Referring back to FIG. 3, the system 30 may also include various sensors 34 for generating signals indicative of corresponding operational conditions of engine 10 and other vehicular components. In this preferred embodiment, sensors 34 include a crankshaft sensor and an accelerator pedal sensor. The crankshaft sensor generates a position (POS) signal each time the crankshaft advances through a unit crank angle of 1 degree, and a reference (REF) signal each time the crankshaft advances a predetermined reference crank angle of 180 degrees in the case of four cylinders and 120 degrees in the case of six cylinders. The accelerator pedal sensor is coupled with a vehicle accelerator pedal 36 through which the vehicle operator can express power or torque demand. The accelerator pedal generates a vehicle accelerator pedal opening (VAPO) signal indicative of opening angle or position of the accelerator pedal 36. The sensors 34 are in electrical communication with a control unit 40 via input ports 42. Control unit 40 preferably includes a microprocessor 44 in communication with various computer readable storage media 46 via data and control bus 48. Computer readable storage media 46 may include any of a number of known devices, which function as a read-only memory (ROM) 50, random access memory (RAM), keep-alive memory (KAM) 54, and the like. The computer readable storage media 46 may be implemented by any of a number of known physical devices capable of storing data representing instructions executable by a computer such as control unit 40. Known devices may include, but are not limited to, PROM, EPROM, EEPROM, flash memory, and the like in addition to magnetic, optical, and combination media capable of temporary or permanent data storage.

Computer readable storage media 46 include various program instructions, software, and control logic to effect control of engine 10. Control unit 40 receives signals from sensors 34 via input ports 42 and generates output signals that are provided to fuel injectors 18 and spark plugs 56 via output ports 58.

With continuing reference to FIG. 3, a logic unit 60 determines the type of ignition required: auto-ignition or spark-ignition, and determines the type of fuel injection required: split or single. If split injection is required for auto-ignition, logic unit 60 provides varying ratios at which total fuel injection quantity is divided into first and second fuel quantities for first and second injections against varying engine loads. The ratio may be represented by a percentage of the first fuel quantity to the total fuel injection quantity. In this case, the second fuel quantity is given by subtracting the first fuel quantity from the total fuel injection quantity so that the first and second fuel quantities may be referred to as a portion and the remaining portion (or the remainder) of the total fuel injection quantity, respectively. For enhancement of auto-ignition, the logic unit 60 controls timings for the first and second fuel injections to accomplish auto-ignition at an appropriate crank position in the neighborhood the piston TDC position of compression stroke. Logic unit 60 may be included in the functions of microprocessor 44, or may be implemented in any other inner known elements in the art of hardware and software control systems. It will be appreciated that logic unit 60 may be a part of control unit 40, or may be an independent control unit that is in communication with control unit 40.

As will be appreciated by one of ordinary skilled in the art, the control logic may be implemented or effected in hardware, or a combination of hardware and software. The various functions are preferably effected by a. programmed microprocessor, but may include one or more functions implemented by dedicated electric, electronic, or integrated circuits. As will also be appreciated, the control logic may be implemented using any one of a number of known programming and processing techniques or strategies and is not limited to the order or sequence illustrated here for convenience. For example, interrupt or event driven processing is typically employed in real-time control applications, such as control of a vehicle engine. Likewise, parallel processing or multi-tasking systems may be used. The present invention is independent of the particular programming language, operating system, or processor used to implement the control logic illustrated.

Figure 4:
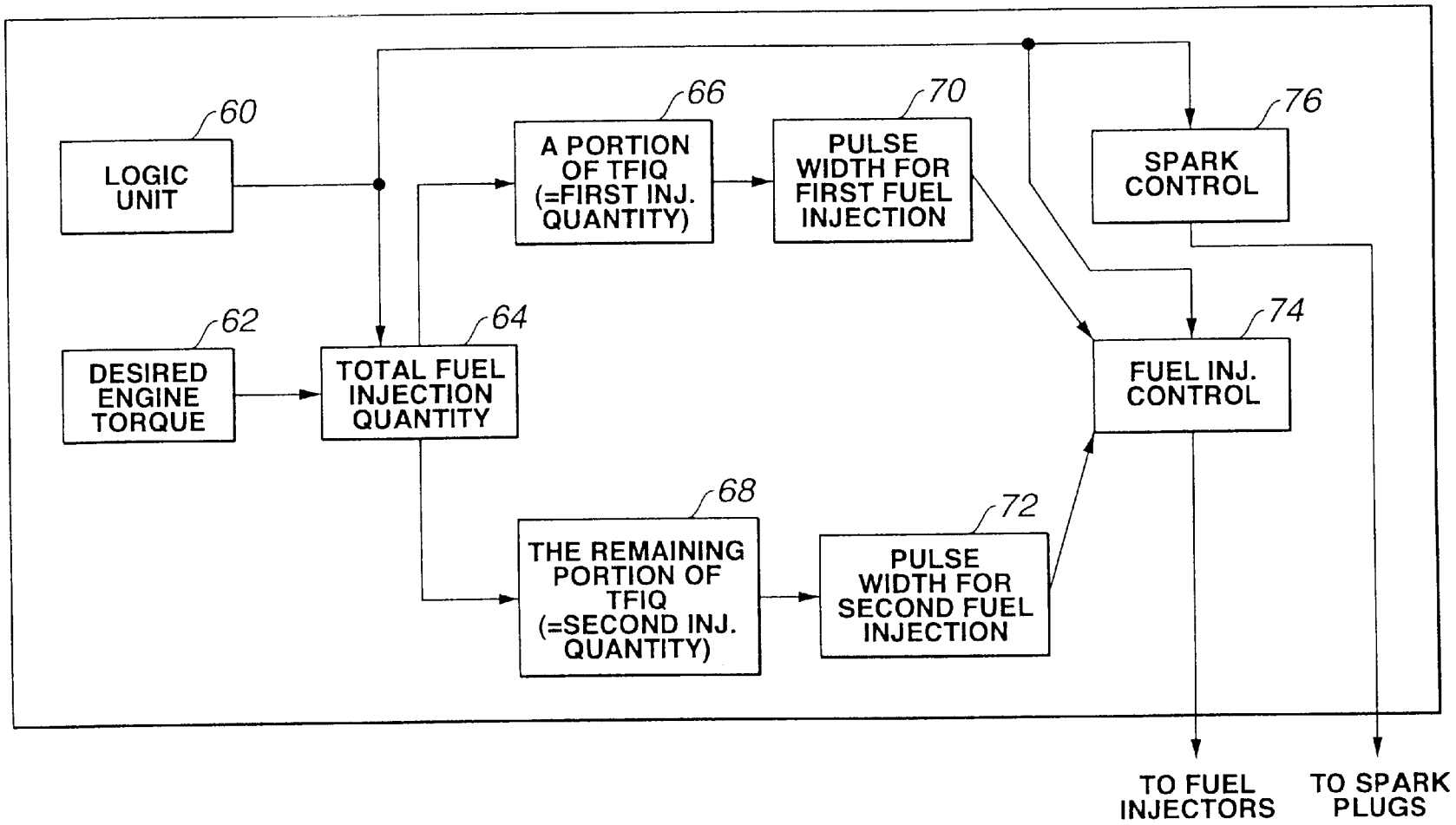
FIG. 4 is a functional block diagram illustrating fuel delivery control in accordance with the present invention.
Figure 13:
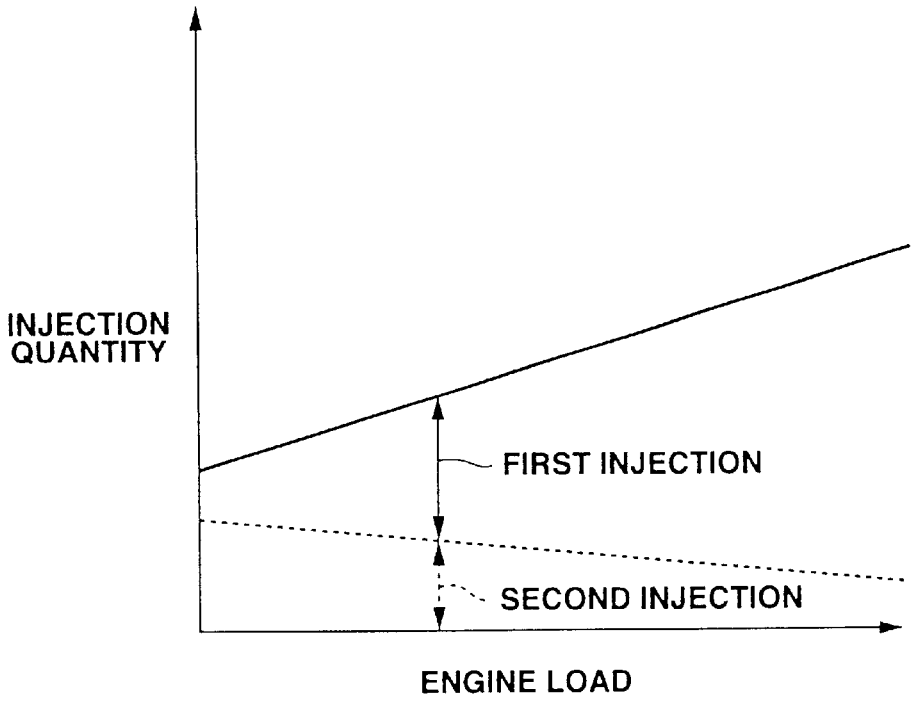
FIG. 13 illustrates variation of a ratio of fuel quantity for the first fuel injection (=first injection quantity) to the total fuel injection quantity against variation of engine load.
Figure 16:
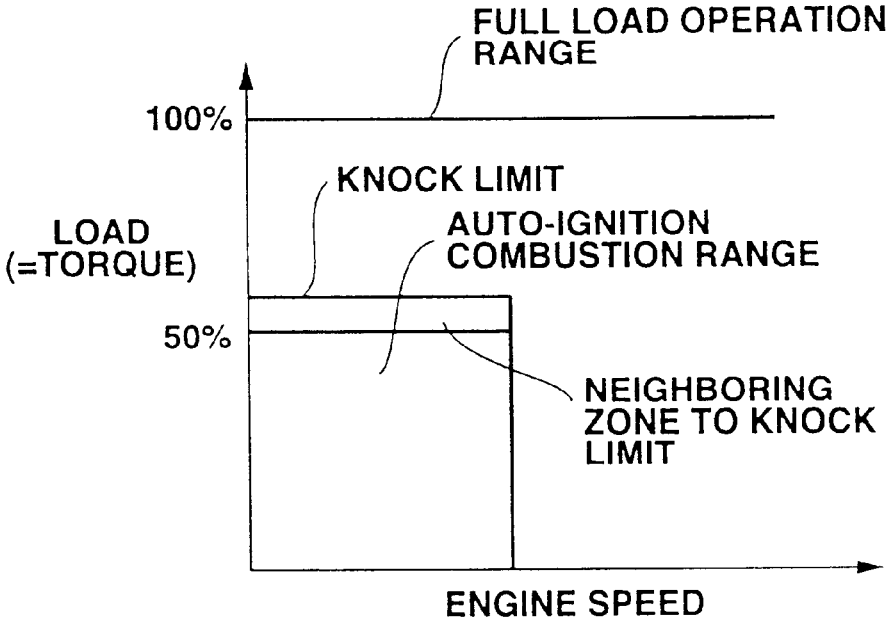
FIG. 16 is a diagram illustrating the zone of an auto-ignition combustion mode bounded by an engine load threshold (=knock limit) and an engine speed threshold.
Figure 17:
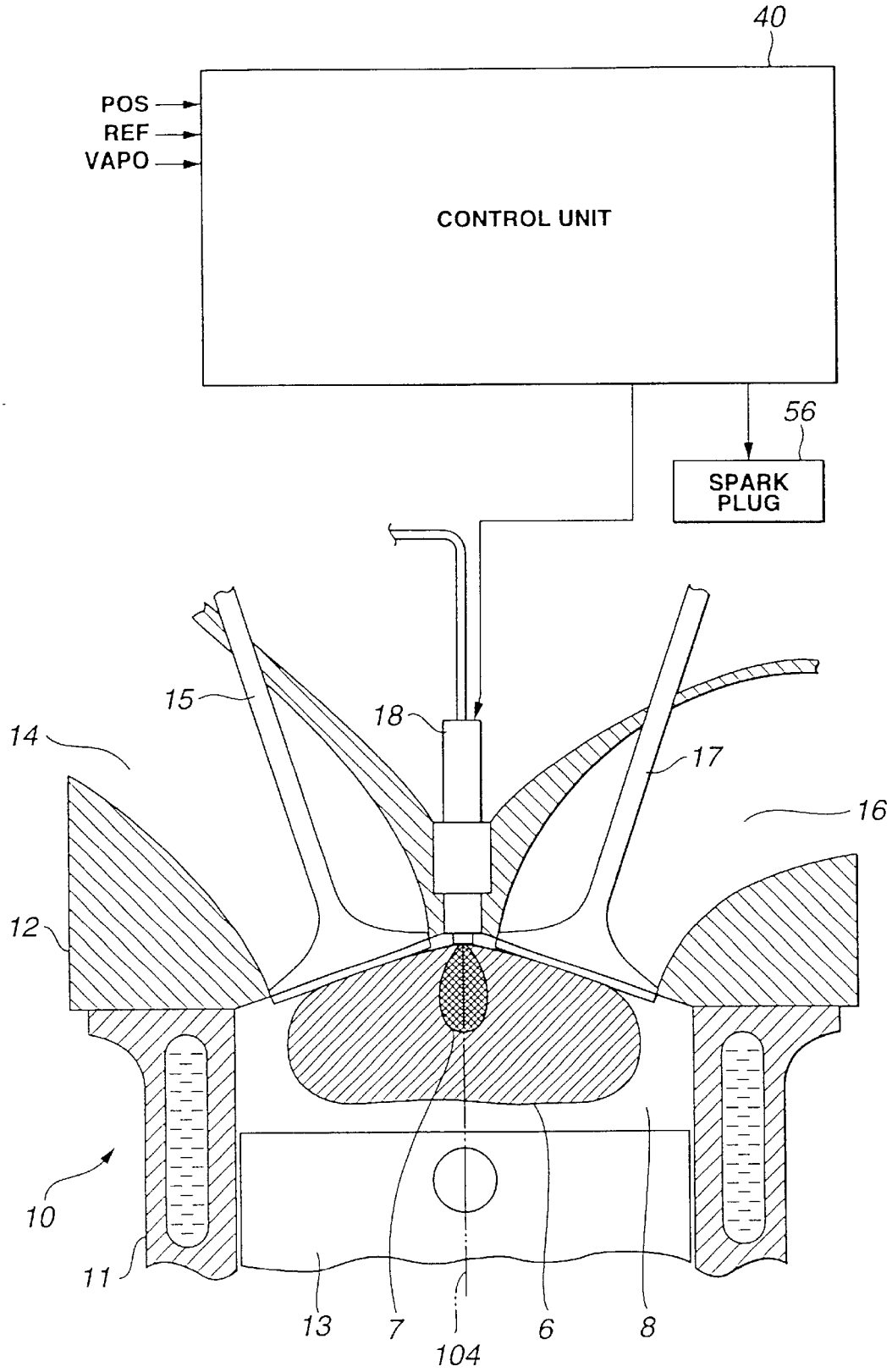
FIG. 17 is a schematic diagram, similar to FIG. 1, illustrating the cylinder content established by a system for enhanced auto-ignition management made in accordance with the present invention.
Figure 24:
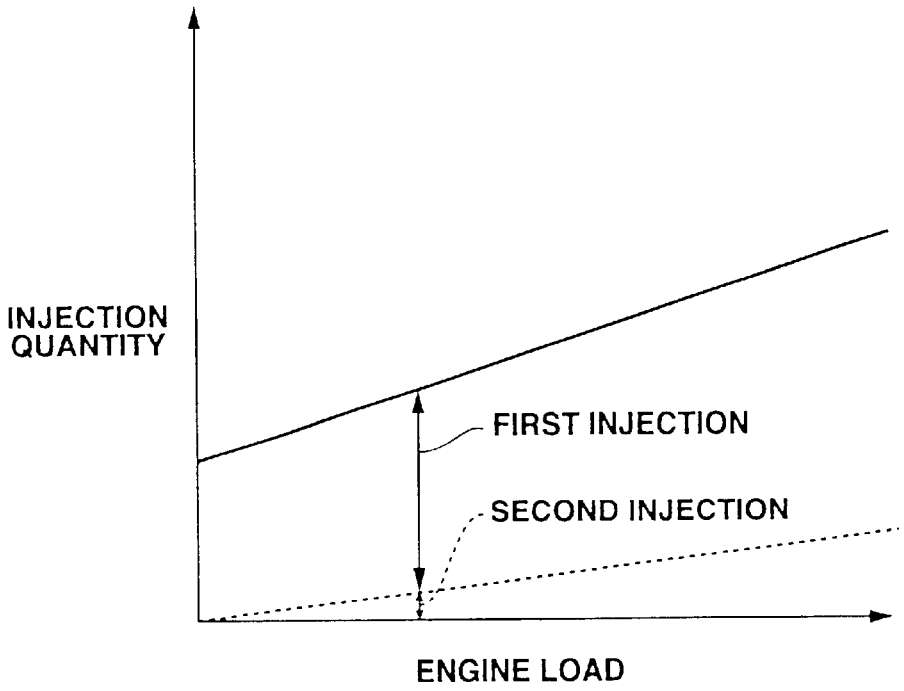
FIG. 24 illustrates variation of a ratio of fuel quantity for the first fuel injection (=first injection quantity) to the total fuel injection quantity against variation of engine load.

Referring to FIG. 4, a functional block diagram illustrates split injection control for enhanced auto-ignition. Split injection, which is the delivering of fuel in two discrete quantities can reduce or eliminate ignition delay. A desired engine torque 62 is determined based on various operating conditions such as engine speed (rpm), vehicle accelerator pedal opening (VAPO), and transmission ratio. Engine speed may be determined based on POS signal generated by the crankshaft sensor. Desired engine torque may be determined based on VAPO signal and engine speed. Alternatively, percent load could be used for the purpose of system control instead of engine torque 62. A total fuel injection quantity or fuel quantity per cycle 64 is determined based on the desired engine torque or the engine load. At the ratio determined by logic unit 60, the total fuel injection quantity (TFIQ) is divided into fuel quantity (or first injection quantity) 66 for first fuel injection and fuel quantity or second injection quantity) 68 for second fuel injection. In one embodiment, the fuel quantities 66 and 68 for the first and second fuel injections are proportioned as illustrated in FIG. 13. In another embodiment they are proportioned as illustrated in FIG. 24. In each of the embodiments, the total fuel injection quantity is determined based on desired, engine torque or engine load, and the fuel quantities 66 and 68 are determined as a portion and the remaining portion of the total fuel injection quantity. During relatively high load operation near knock limit as illustrated in FIG. 16, logic unit 60 determines the ratio so that the fuel quantity for the second fuel injection is less than the fuel quantity for the first fuel injection. Preferably, in each of the embodiments, the fuel quantity for the second fuel injection is less than 40 percent of the total fuel injection quantity and greater than 20 percent of the total fuel injection quantity for reducing NOx emission and particle emission by restricting volume within the combustion chamber where the combustion peak at high temperature takes place. The total fuel injection quantity 64 and the ratio to be determined by logic unit 60 are preferably located in look-up tables.

The quantity of fuel to be sprayed for fuel injection is represented by a duration of pulse. Two such pulse width values are determined. The values of the pulse widths are found in a look-up table. A pulse width for first fuel injection 70 corresponds to the value of first injection quantity 66, while a pulse width for second fuel injection 72 corresponds to the value of second injection quantity 68.

Figure 14:
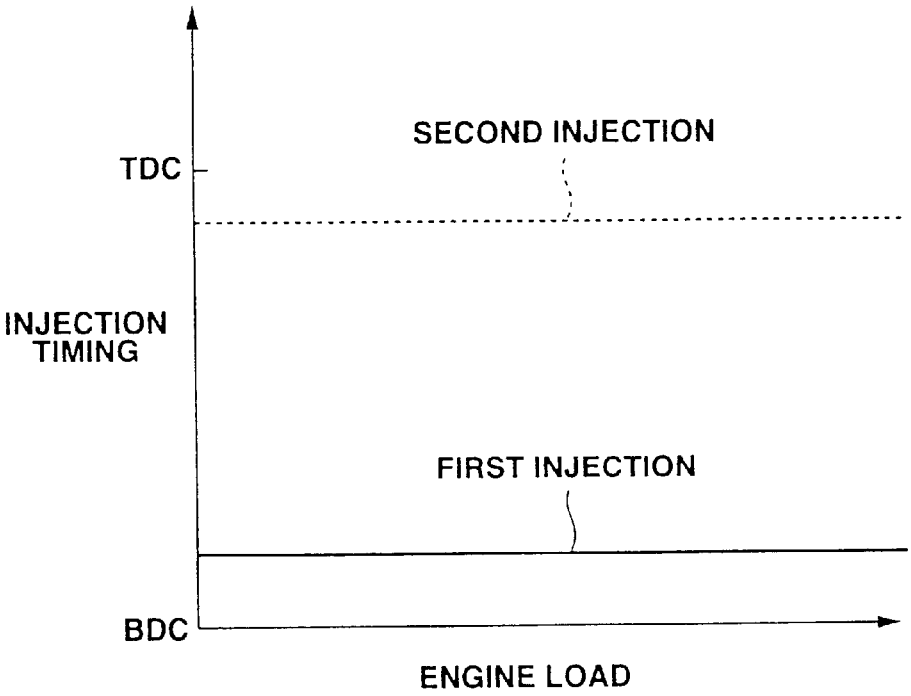
FIG. 14 illustrates graphically injection timings for the first and second fuel injections, respectively.
Figure 25:
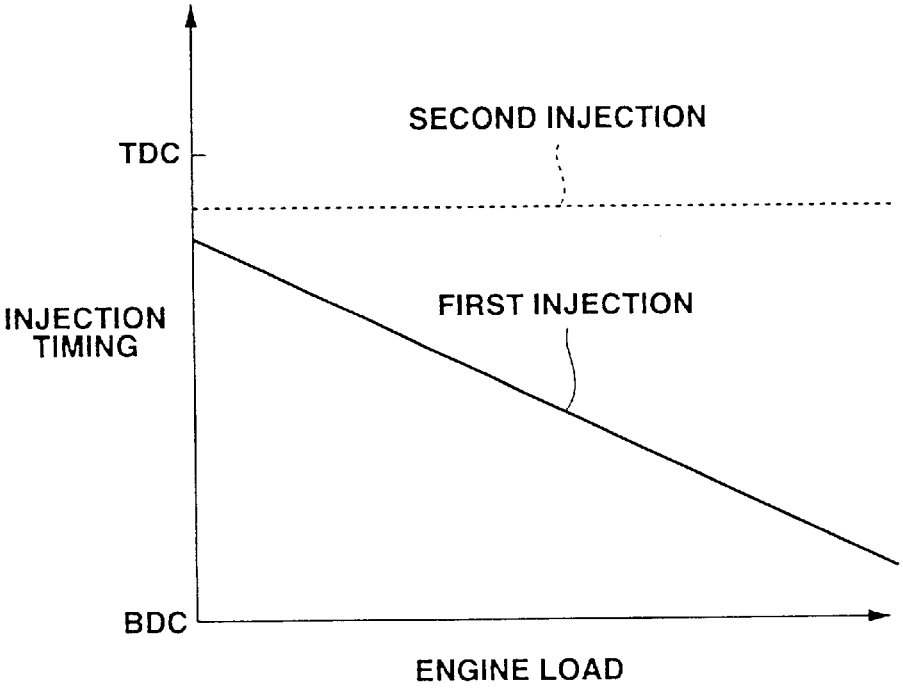
FIG. 25 illustrates graphically load dependent variation of injection timing for the first fuel injection and invariable injection timing for the second fuel injection.

Fuel injector control 74 initiate and terminates the first and second fuel injections, and communicates with logic control 60 to control fuel. Logic unit 60 cooperates with fuel injector control to precisely control fuel injection timing. Start time of the first fuel injection is adjusted to a crank position falling in a range from intake stroke to a crank position within the subsequent compression stroke, while start time of the second fuel injection is adjusted to a crank position falling in the second or last half of the compression stroke. In one embodiment, the start time of the first fuel injection is set at a crank position falling in the first or initial half of compression stroke, while the start time of the second fuel injection is set at a crank position falling in the second or last half of the compression stroke as illustrated in FIG. 14. As clearly shown in FIG. 14, start time of each of the first and second fuel injections are held invariable against varying engine loads. In another embodiment, as illustrated in FIG. 25, the start time of the first fuel injection is varied against varying engine loads, while the start time of the second fuel injection is held invariable. During low load operation, the start time of the first fuel injection approaches the crank position of the second fuel injection. In other words, the first fuel injection performs the function of the second fuel injection.

Spark control 76 communicates with logic unit 60 to control production of spark. Logic unit 60 cooperates with spark control 76 to suspend generation of sparks if auto-ignition is required.

Figure 5:
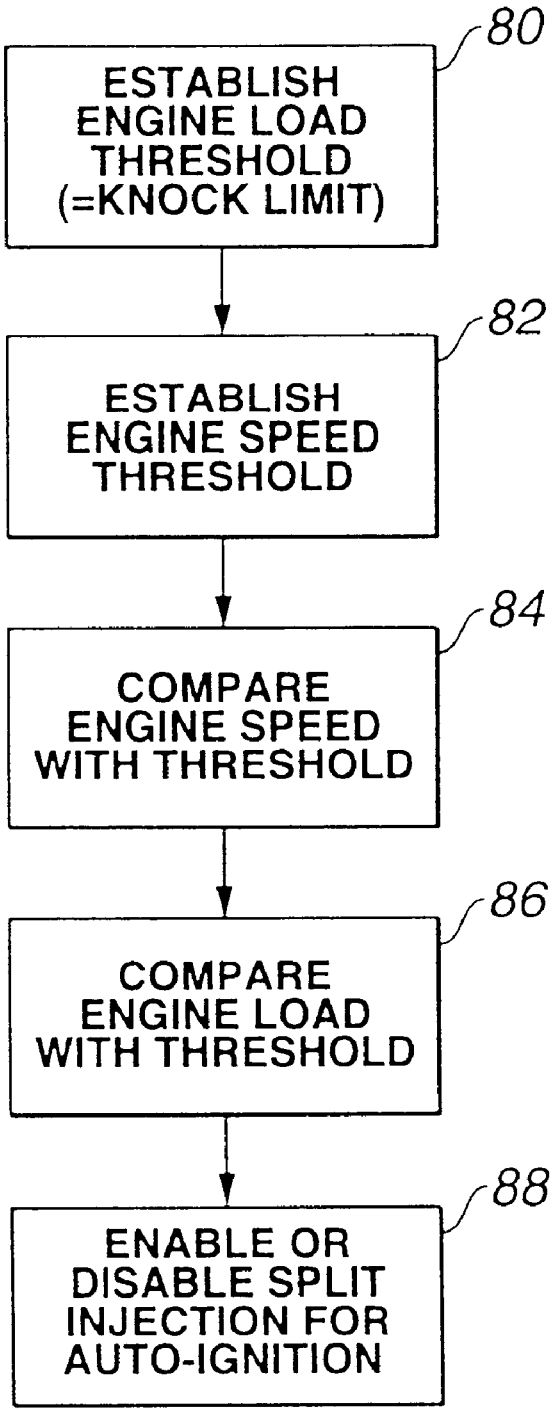
FIG. 5 is a block diagram illustrating a method of the present invention for enabling or disabling split injection for auto-ignition based on engine speed and load.

Referring now to FIG. 5, a method for enabling or disabling split injection for auto-ignition is illustrated. If split injection is disabled, single injection for spark-ignition is enabled and spark control 76 is enabled to control production of spark.

At step 80, an engine load threshold is established. This value is established in a variety of different ways. In a preferred embodiment, the values of engine load threshold are found in a look-up table as illustrated in FIG. 16 referenced by engine speed. In FIG. 16, the values of engine load threshold are illustrated by the fully drawn line labeled knock limit. At step 82, an engine speed threshold is established. The value of engine speed threshold may be determined from the look-up table illustrated in FIG. 16.

At step 84, engine speed is compared with the established engine speed threshold. At step 86, engine load is compared with the engine load threshold. At step 88, split injection is disabled when the engine speed exceeds the engine speed threshold or when the engine load exceeds the engine load threshold (=knock limit), and enabled when subsequently the engine load drops below the engine load threshold less a hysteresis value.

Figure 6:
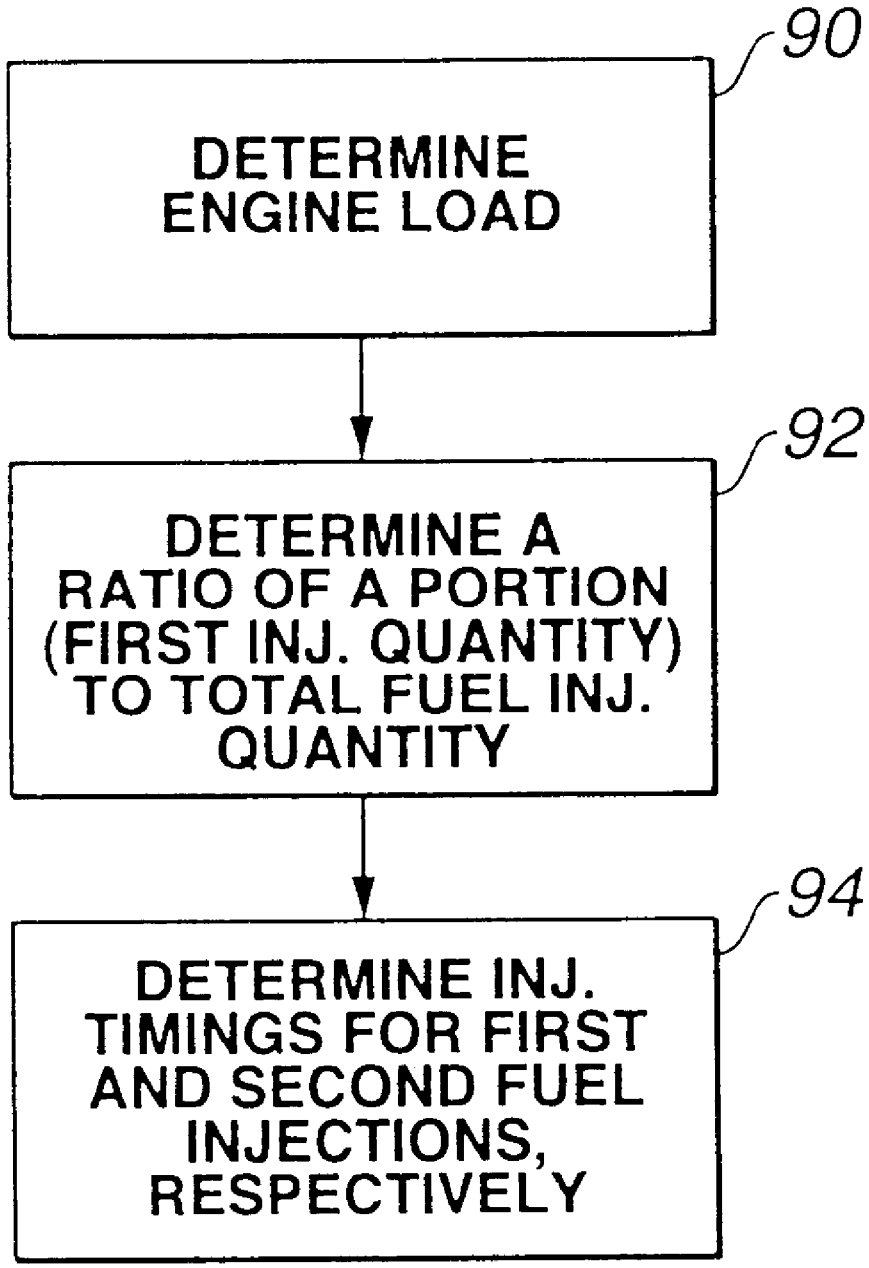
FIG. 6 is a block diagram illustrating a method of the present invention for determining a ratio at which a total fuel injection quantity is divided into fuel quantities for first and second fuel injections based on engine load and for determining injection timings for the first and second fuel injections, respectively.

Referring to FIG. 6, a method of controlling split injection for enhanced auto-ignition engine is illustrated. At step 90, engine load is determined. Alternatively, desired engine torque may replace engine load. At step 92, a ratio at which the total fuel injection quantity is divided into the first and second injection quantities is determined. In a preferred embodiment, the ratio is represented by a ratio of a portion (first injection quantity) to the total fuel injection quantity. The value of this ratio is found in a look-up table referenced by engine load or desired engine torque. As illustrated in FIGS. 13 and 24, in each of embodiments, the ratio is determined so that, during high load operation in the neighborhood of the knock limit (see FIG. 16), the second injection quantity is less than the first injection quantity and can be represented by a percentage, which falls in a range from 20% to 40%, of the total fuel injection quantity. Under this condition, the first injection quantity can be represented by a percentage that falls in a range from 60% to 80%. At step 94 injection timings for the first and second fuel injections are determined. As illustrated in FIGS. 14 and 25, in each of the embodiments, timing of the first fuel injection falls in the first half of compression stroke during high load operation in the neighborhood of knock limit, while timing of the second fuel injection falls in the second half of the compression stroke. During high load operation in the neighborhood of knock limit, the injection quantities and timings as illustrated in FIGS. 13 and 14 or FIGS. 24 and 25 are required to accomplish controlled auto-ignition at an appropriate crank position in the neighborhood of the piston TDC of compression stroke.

Figure 7:
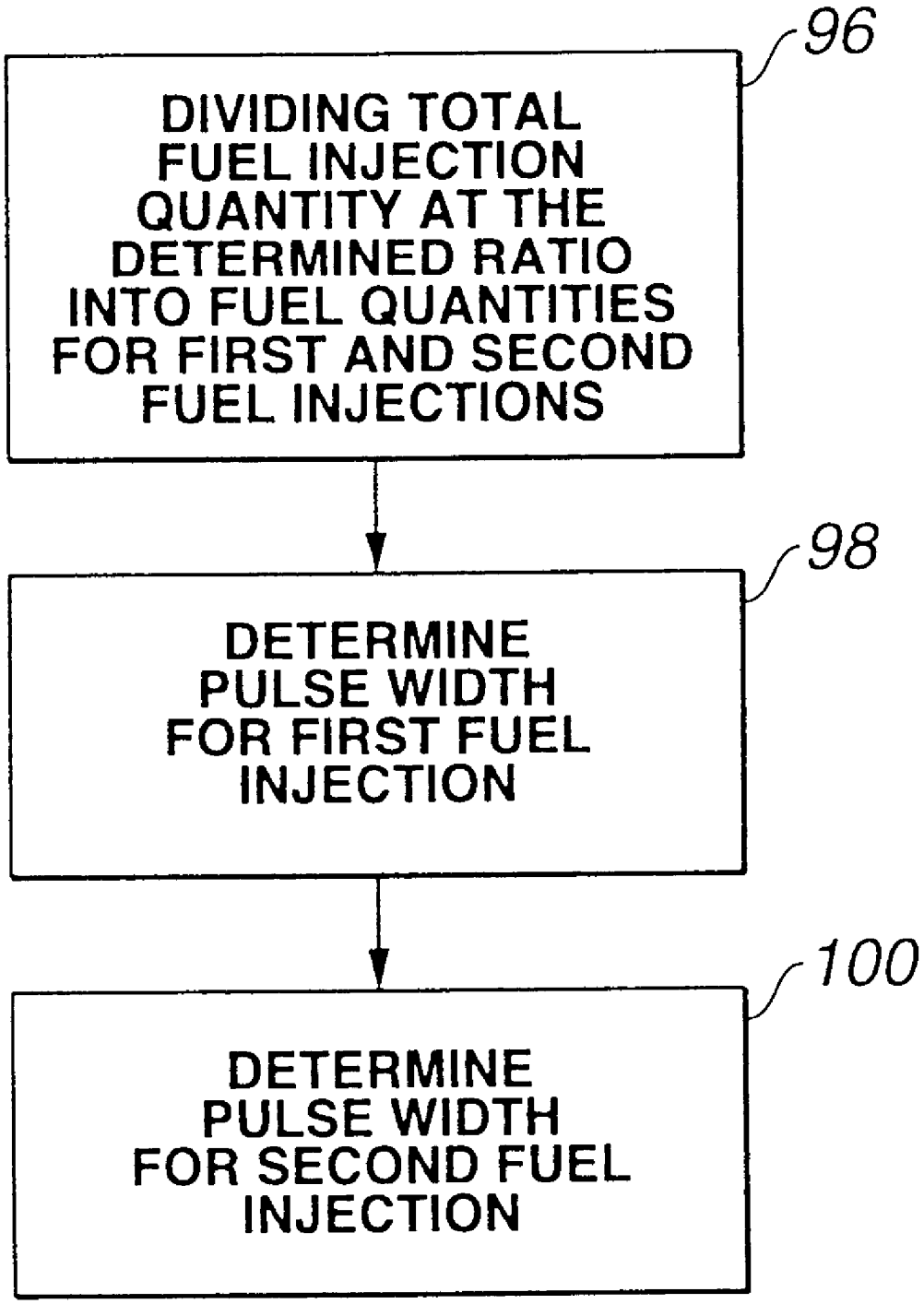
FIG. 7 is a block diagram illustrating a method of the present invention for dividing the total fuel injection quantity into a portion for the first fuel injection and the remaining potion for the second fuel injection.

Referring to FIG. 7, a method for dividing the total fuel injection quantity into first and second injection quantities is illustrated. At step 96, the total fuel injection quantity is divided into fuel quantities for first and second fuel injections using the ratio determined at step 92 shown in FIG. 6. At step 98, a pulse width corresponding the fuel quantity for the first fuel injection is determined. At step 100, a pulse width corresponding to the fuel quantity for the second fuel injection is determined.

Figure 8:
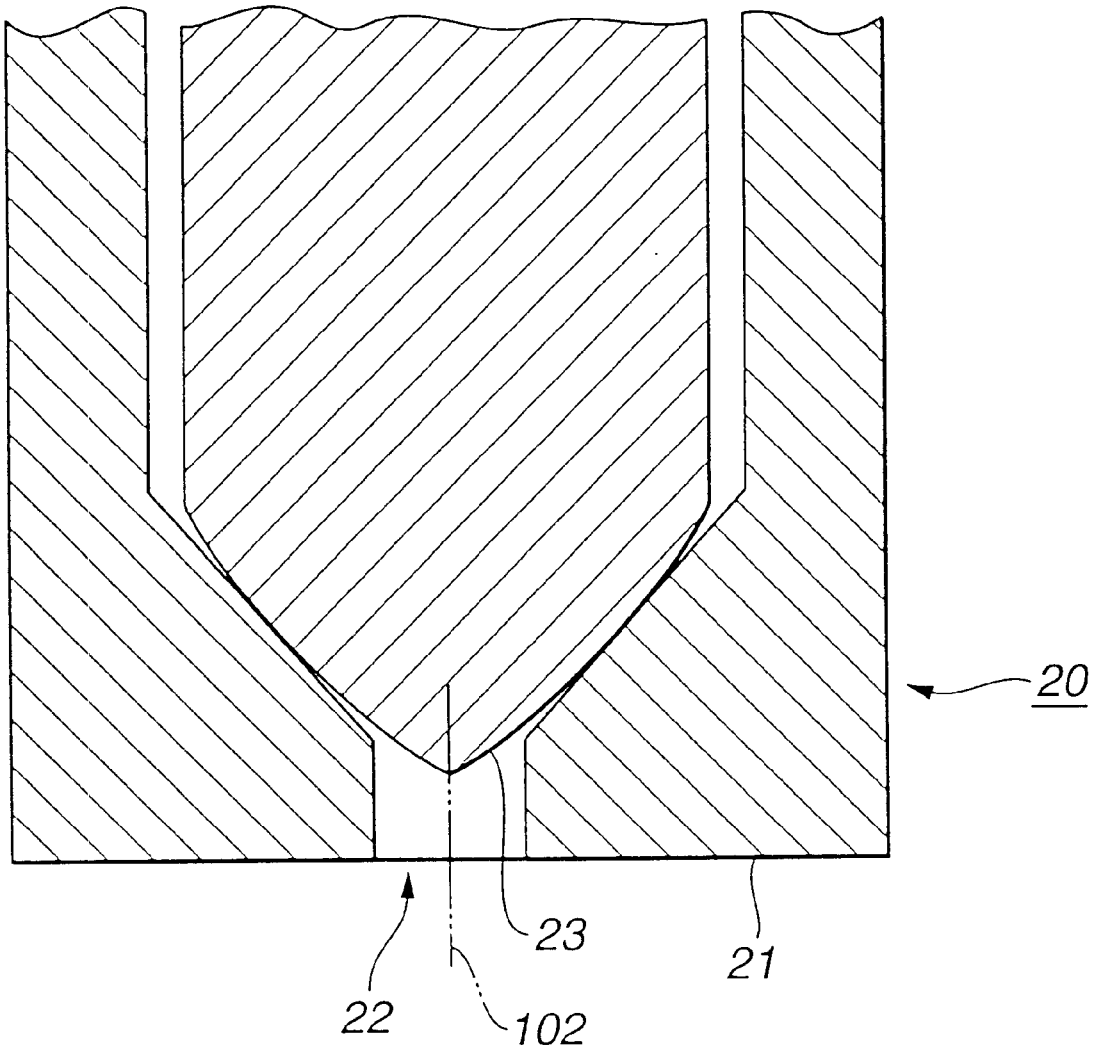
FIG. 8 is a schematic diagram illustrating a spout structure of a hollow cone swirl nozzle of a fuel injector.
Figure 9:
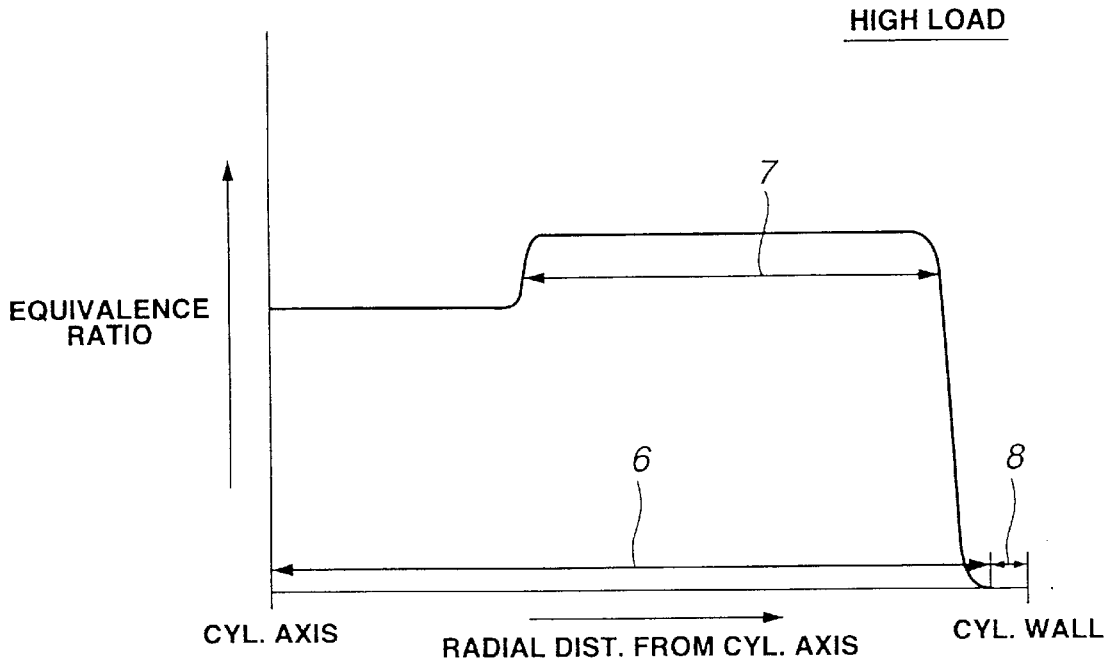
FIG. 9 illustrates graphically the cylinder content during high load operation in auto-ignition combustion mode at a crank position of the piston in the neighborhood of top dead center position of compression stroke.

Referring to FIGS. 1, 8, 9 and 10, FIG. 1 illustrates the cylinder content at a crank position upon termination of second fuel injection via a hollow cone nozzle 20 of the fuel injector 18 as will be described in connection with FIG. 8. FIG. 9 graphically represents the cylinder content for auto-ignition during high load operation, while FIG. 10 graphically represents the cylinder content for auto-ignition during low load operation.

Referring to FIG. 8, a nozzle body 21 is formed with the spout 22. A needle valve 23 is moveable within body 21 and normally closes spout 22 when no current passes through its associated driver coil (not shown). A fuel injection control pulse signal controls the duration of time for which current passes through the driver coil. Current passing through the driver coil induces electromagnetic force that lifts the needle valve 23 from the illustrated close position, opening spout 22, allowing the passage of fuel. Torque is imparted to the fuel passing through spout 22, causing the fuel to generate swirl around a nozzle axis 102, promoting the fuel to spread outwardly along a cone surface of an imaginary circular cone. This circular cone is a solid bounded by a region enclosed in a circle about the extended line of nozzle axis 102 and the cone surface formed by the segments joining each point of the circle to a point outside of the region and on the nozzle axis 102 within spout 22. Preferably, spout 22 is oriented such that immediately after termination of fuel injection, a conical ring shaped air/fuel mixture cloud remains about a cylinder axis 104 (see FIG. 1). This cloud surrounds the cylinder axis 104 with its outer boundary extending along the circle defining the region of the imaginary circular cone. A top angle of this imaginary circular cone and fuel delivery pressure are determined such that the conical ring shaped mixture cloud will not come into contact with the cylinder inner wall when fuel is sprayed into the cylinder. As compared to the other types of nozzles, the hollow cone nozzle 20 will work with relatively low fuel delivery pressure.

Referring to FIG. 1, pressure in the cylinder at injection timing determines the diameter of a circle, which the outer boundary of conical ring shaped mixture cloud extends. At injection timing for first fuel injection, which falls in intake stroke or the first or initial half of compression stroke, the cylinder pressure is not too high. Under this condition, fuel particles sprayed can fly easily and the average trajectory of fuel particles is long, creating a first conical ring shaped mixture cloud. This first conical ring shaped mixture cloud formed upon termination of first fuel injection has its outer boundary extending, out of contact with the cylinder inner wall, along a first circle defining the enclosed region of a first circular imaginary cone. As piston 13 ascends toward fuel injector 18 during compression stroke, the first conical ring shaped mixture cloud will no longer hold its original ring configuration. Due to compression in volume of combustion chamber between piston 13 and cylinder head 12, the conical ring shaped cloud populated by the fuel particles of the first fuel injection becomes a solid circular body as diagrammatically shown at 6 in FIG. 1 by the time the piston 13 approaches a crank position where second injection is to start. At timing for the second fuel injection, which falls in the second or last half of compression stroke, the cylinder pressure is very high. Under this condition, fuel is sprayed into the circular solid body 6 populated by fuel particles of the first fuel injection. Because of high cylinder pressure, the fuel particles cannot fly easily and thus the average trajectory of fuel particle is short as diagrammatically illustrated at 7 in FIG. 1, creating a second ring shaped mixture cloud. This second ring shaped mixture cloud stays within the circular solid body 6 and has its outer boundary extending along a second circle defining the enclosed region of a second circular imaginary cone. The first and second circular imaginary cones have the common top angle so that the first and second circles of the cones surround the cylinder axis 104. This second ring shaped mixture cloud is superimposed on a portion of the solid circular body 6. This superimposed portion is populated by the fuel particles of the first and second fuel injections so that the density of fuel particles within the superimposed portion is high enough to accomplish auto-ignition at an ignition point in the neighborhood of the piston TDC position of compression stroke. If simultaneous burning of the fuel particles of the superimposed portion is required, the superimposed portion should stay in an area portion where the temperature within the cylinder is high and the gradient of temperature against radial distance from the cylinder axis 104 is almost zero. If there is a need for gradual burning of the fuel particles of the superimposed portion, the superimposed portion should stay in another area portion where the gradient of temperature against radial distance from the cylinder axis 104 exits. The high temperature and high pressure resulting from the burning of the fuel in the superimposed portion cause auto-ignition of fuel particles within the remaining portion of the solid circular body 6.

Figure 10:
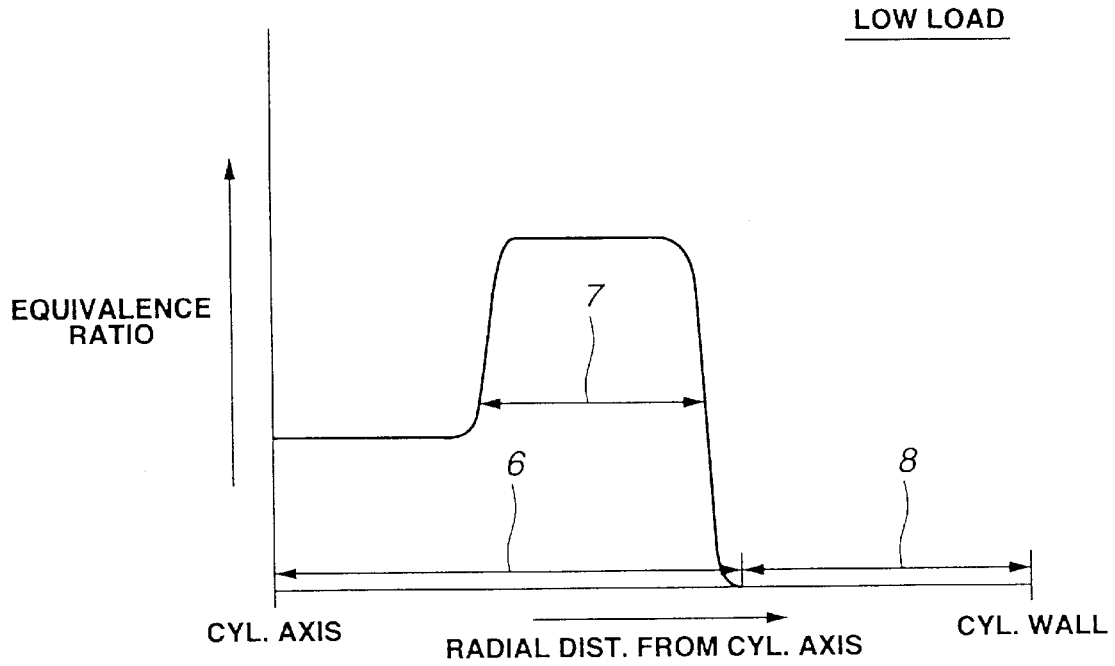
FIG. 10 illustrates graphically the cylinder content during low load operation in auto-ignition combustion mode at the crank position of the piston in the neighborhood of TDC position of compression stroke.

In a preferred embodiment, injection quantities and timings are determined from FIGS. 13 and 14 to control split injection via spout 22 shown in FIG. 8 to establish the cylinder content as graphically represented by FIG. 9 during high load operation or by FIG. 10 during low load operation.

Referring to FIG. 13, the fully drawn line illustrates variation of total fuel injection quantity that is determined based on engine load or desired engine torque. The total fuel injection quantity decreases as the engine load decreases. At a given value of engine load, the total fuel injection quantity is divided into injection quantity for the first fuel injection and injection quantity for the second fuel injection as illustrated in FIG. 13. The first injection quantity of fuel is sprayed at injection timing for the first fuel injection and the second injection quantity of fuel is sprayed at injection timing for the second fuel injection. Referring to FIG. 14, the injection timings are unaltered against variation of engine load. In the embodiment, injection timing for the first fuel injection falls in the first half of compression stroke, while injection timing for the second fuel injection falls in the second half of compression stroke.

In FIG. 13, injection quantities for second and first fuel injections at a given value of engine load are indicated by the length of a vertical line segment joining a point indicating the given value of engine load to a point on the dotted line and by the length of a vertical line segment joining the point on the dotted line to a point on the fully drawn line, respectively. As the engine load decreases, injection quantity for the first fuel injection decreases, while injection quantity for the second fuel injection increases. In other words, a ratio of injection quantity for the first fuel injection to the total fuel injection quantity decreases as the engine load decreases so as to allow an increase in injection quantity for the second fuel injection during low load operation to achieve auto-ignition.

If injection timing is fixed, injection quantity for first fuel injection determines the diameter of solid circular body 6. As readily seen from FIG. 13, injection quantity for first fuel injection is significantly less during low load operation than that during high load operation so that the diameter of solid circular body 6 is significantly less during low load operation than that during high load operation as will be discussed below in connection with FIGS. 9 and 10.

FIG. 4 graphically represents variation of equivalence ratio of the cylinder content at or near the TDC position of compression stroke during high load operation against variation of radial distance from the cylinder axis 104. Likewise, FIG. 5 graphically represents variation of equivalence ratio of the cylinder content at or near the TDC position of compression stroke under low load operation. In each of FIGS. 4 and 5, a closed outer layer, whose depth is indicated by a double headed arrow 8, extends along to cover the cylinder inner wall to prevent fuel particles from coming into contact with the cylinder inner wall. The outer layer 8 contains air. The depth of this outer layer 8 during low load operation is significantly greater than that during high load operation. The depth of this air layer during low load operation is so chosen as to prevent combustion flame from coming into contact with the cylinder inner wall during expansion stroke. The radial extension (or radius) of the solid circular body 6 from the cylinder axis 104 (or radius) is indicated by the double headed arrow with the same reference numeral. The radial extension of the superimposed portion 7, which is populated not only by fuel particles of the first fuel injection but also by fuel particles of the second fuel injection, is indicated by the double headed arrow with the same reference numeral.

As illustrated in FIG. 9, during high load operation, the split injection establishes the cylinder content wherein the remaining portion of the solid circular body 6 is formed in the vicinity of the cylinder axis 104, while the superimposed portion 7 extends outwardly of and surrounds the remaining portion. Flatly speaking, the superimposed portion 7 takes the shape of an annular band surrounding. the remaining portion of the solid circular body 6. The outer layer 8 surrounds the solid circular body 6. In order to ensure formation of the outer layer 8, the timing of first fuel injection should fall in a range from the beginning of the second half of intake stroke to the termination of the first half of compression stroke. The equivalence ratio of the superimposed portion 7 is greater than that of the remaining portion of the circular solid body 6. This means that the density of fuel particles populating the superimposed portion 7 is higher than the density of fuel particles populating the remaining portion of the circular solid body 6.

Comparing FIG. 10 with FIG. 9 clearly reveals that the diameter of circular solid body 6 is significantly less during low load operation than that during high load operation. In FIG. 10, the remaining portion of the solid circular body 6 extends outwardly from the cylinder axis 104 as far as one thirds (⅓) of the radius of cylinder bore. The annular band shaped superimposed portion 7 surrounds the remaining portion of the circular solid body 6 and extends outwardly as far as two thirds (⅔) of the radius of cylinder bore. The outer layer 8 containing air surrounds the circular solid body 6 and extends to cover the inner wall of the cylinder. A difference in equivalence ratio between the remaining portion of the circular solid body 6 and the superimposed portion 7 during low load operation is considerably greater than that during high load operation (see FIG. 9). This is needed to accomplish auto-ignition during low load operation. The outer air layer 8 is sufficiently deep during low load operation so that the fuel particles burn completely before combustion flame comes into contact with the relatively low temperature cylinder wall. As a result, HC emission is below a sufficiently low level near zero.

Figure 15:
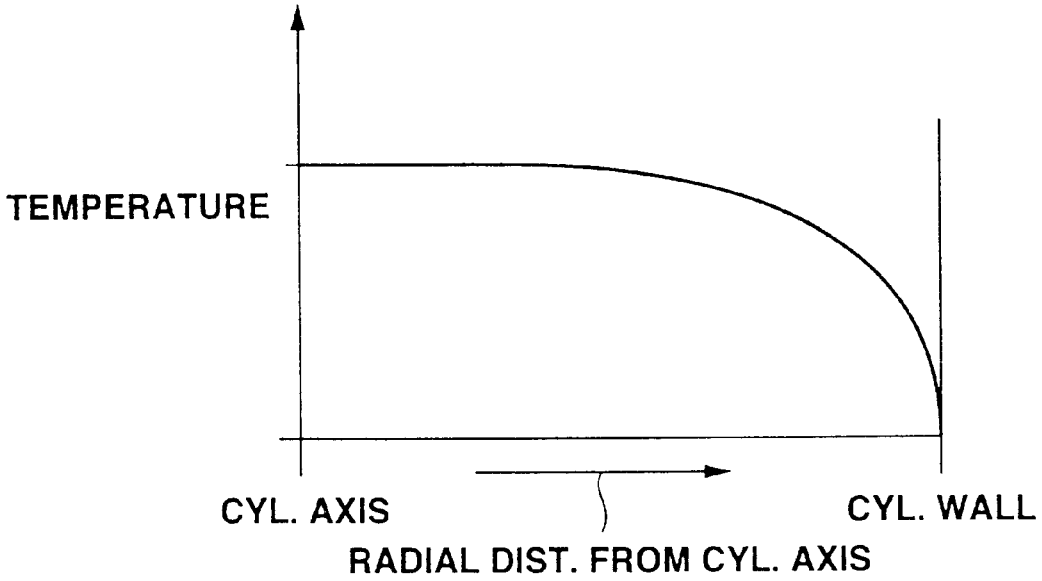
FIG. 15 illustrates graphically distribution of temperature in a cylinder against variation of radial distance from the cylinder axis.

In the embodiment, the superimposed portion 7 is located in spaced relationship from the cylinder axis 104 to accomplish slow burn of the fuel particles without any excessively high temperature peaks. Referring to FIG. 15, the gradient of temperature within the cylinder against radial distance from the cylinder axis 104 is graphically illustrated. It will be noted that the temperature within the central zone about the cylinder axis is the highest, the temperature at the periphery of the cylinder in contact with the cylinder inner wall is the lowest, and the temperature decreases from, the highest toward the lowest gradually within an intermediate zone and rapidly within a peripheral zone. The intermediate zone is adjacent to and surrounds the central zone and the peripheral zone is adjacent to the intermediate zone and extends between the intermediate zone and the periphery of the cylinder. Comparing FIG. 9 with FIG. 15 clearly reveals that, during high load operation, the superimposed portion 7 extends over the central zone and the intermediate zone. Thus, the fuel particles populating the superimposed portion 7 will not simultaneously burn. They burn in different timings because ignitions take place at different sites corresponding to different values of temperature. This slow burn of the fuel particles of the superimposed portion 7 suppresses excessive rise in combustion temperature, reducing production of NOx below a satisfactorily low level near zero. Comparing FIG. 10 wit FIG. 15 reveals that, during low load operation, the superimposed portion 7 extends over the central zone where the temperature is the highest and the equivalence ratio of the superimposed portion 7 is held at a level high enough to achieve auto-ignition upon exposure of fuel particles to temperature above a predetermined level. Besides, the provision of the outer air layer 8 prevents combustion flame from coming into contact with the cylinder inner wall during expansion stroke so that all fuel particles burn completely. This brings about a considerable reduction of HC emission below a satisfactorily low level near zero.

Figure 11:
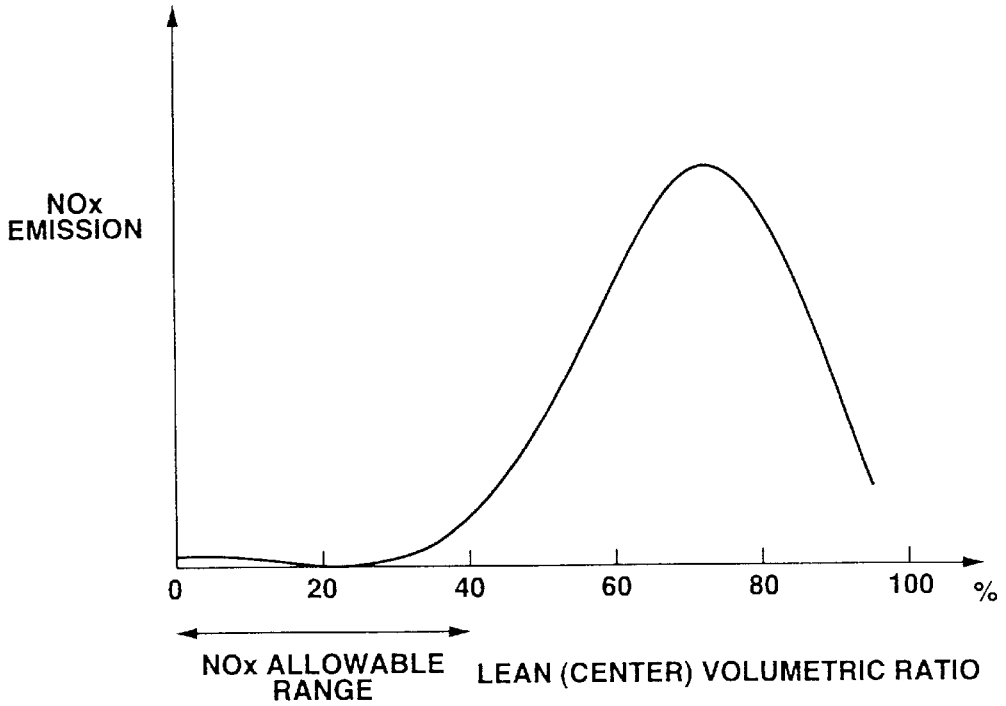
FIG. 11 illustrates graphically variation of nitrogen oxides (NOx) emission against variation of a volumetric ratio of lean mixture portion populated by fuel particles sprayed at the first fuel injection only.
Figure 12:
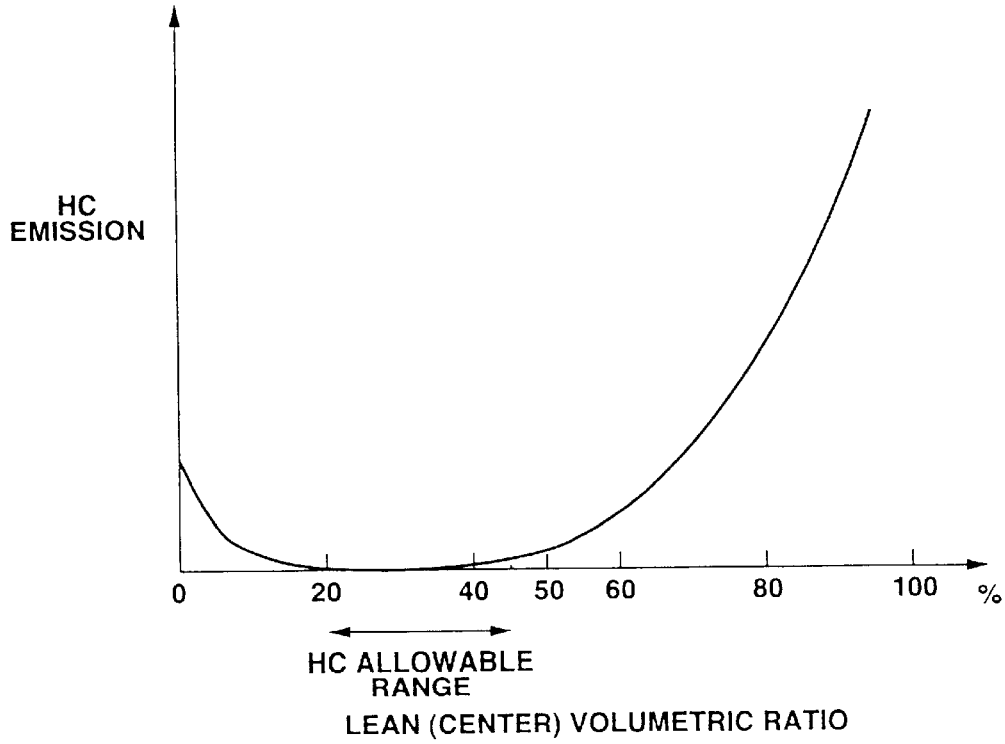
FIG. 12 illustrates graphically variation of hydrocarbon (HC) emission against variation of the volumetric ratio of lean mixture portion populated by fuel particles sprayed at the first fuel injection only.

Referring to FIGS. 11 and 12, NOx and HC emissions are illustrated against various values of a volumetric ratio of the remaining portion of solid circular body 6 to combustion chamber. The term "a lean (center) volumetric ratio" is herein used to mean the above-mentioned ratio because the remaining portion populated by fuel particles of the first fuel injection only stays in the vicinity of the center of the combustion chamber and it is lean as compared to the superimposed portion 7. As readily seen from FIGS. 11 and 12, it is preferred that the lean (center) volumetric ratio falls in a range from 20% to 40% to hold NOx and HC emissions below their satisfactorily low levels, respectively.

FIG. 11 graphically represents variation of NOx emission versus variation of the lean (center) volumetric ratio. The variation characteristic of NOx emission is invariable against varying engine load. FIG. 12 graphically represents variation of HC emission versus variation of the lean (center) volumetric ratio. Likewise, the variation characteristic of HC emission is invariable against varying engine load.

With continuing reference to FIG. 11, NOx emission remains below the satisfactorily low level near zero against varying values of the lean (center) volumetric ratio from 0% to 40%. Increasing the lean (center) volumetric ratio beyond 40% causes NOx emission to exceed the satisfactorily low level. The NOx emission increases and has its peak in the neighborhood of 70%. Thereafter, the NOx emission decreases after hitting this peak.

At or near the TDC position of compression stroke, an increase in the lean (center) volumetric ratio brings about a decrease in volume populated by fuel particles of the second injection, causing an increase in density of fuel particles populating the superimposed portion 7. The increase in density of fuel particles of the superimposed portion 7 causes rapid burn of fuel particles with undesired peak in combustion temperature, resulting in production of considerable amount of NOx. This accounts for increasing tendency of NOx emission toward its peak.

Increasing further the lean (center) volumetric ratio causes the dispersion of fuel particles of the second fuel injection into the surrounding outer air layer by the time piston reaches an auto-ignition position at or near the TDC position of compression stroke. This dispersion of fuel particles into the surrounding outer air layer decreases a portion where fuel burns at high temperature. This accounts for decreasing tendency of NOx emission from the peak when the lean (center) volumetric ratio exceeds 70%.

Turning to FIG. 12, there is an increase in HC emission as the lean (center) volumetric ratio drops below 20%. Under this condition, at or near the TDC position during compression stroke, there is no or little population of fuel particles of the first fuel injection, and fuel particles of the second fuel injection only are responsible for establishing equivalence ratio of a mixture cloud. This mixture cloud is lean and difficult to burn completely, causing production of considerable amount of HC. As the lean (center) volumetric ratio increases and approaches 20%, the ignitability of the mixture is improved by an increase in population of fuel particles of the first fuel injection. This accounts for a decrease in HC emission as the lean (center) volumetric ratio increases and approaches 20%.

Against variation of the lean (center) volumetric ratio from 20% to 45%, HC emission remains below a satisfactorily low level near zero. Increasing the lean (center) volumetric ratio beyond 45% causes HC emission to exceed this satisfactorily low level. Thereafter, HC emission increases at an increasing rate as the lean (center) volumetric ratio approaches 100%.

As previously mentioned in connection with the NOx emission, increasing further the lean (center) volumetric ratio causes the dispersion of fuel particles of the second fuel injection into the surrounding outer air layer by the time piston reaches an auto-ignition position at or near the TDC position of compression stroke. This dispersion of fuel particles into the surrounding outer air layer brings some of the fuel particles into contact with the cylinder inner wall, causing so-called quenching layer to appear during expansion stroke. This accounts for a remarkable increase in HC emission.

Referring to FIG. 13, the total fuel quantity decreases linearly as the engine load decreases as illustrated by the fully drawn line. During high load operation, it is preferred that injection quantity of the first fuel injection ranges from 60% to 80% of the total fuel quantity. Injection quantity of the second fuel injection corresponds to the remainder of the total fuel quantity. Thus, injection quantity of the second fuel injection ranges from 40% to 20% of the total fuel quantity.

As the engine load decreases, injection quantity of the first fuel injection decreases. The excess air ratio of mixture created by fuel particles of the first fuel injection only increases as the engine load decreases. Injection quantity of the second fuel injection increases as the engine load decreases. The excess air ratio of the superimposed portion populated by fuel particles of the first and second fuel injections decreases as the engine load decreases. A difference between the two excess air ratios ranges from 0 to 1.0 during high load operation. This difference drops as the engine load decreases.

With regard to the injection timing shown in FIG. 14, the second injection starts at an appropriate crank position falling in the second half of compression stroke before the TDC position, while the first injection starts at an appropriate crank position falling in the first half of the compression stroke. The injection timing of the first injection may be set at an appropriate crank position of intake stroke. Preferably, the injection timing of the second injection is chosen such that auto-ignition of the superimposed portion 7 will take place at a crank position immediately after the compression stroke.

FIG. 16 illustrates auto-ignition combustion range. Parameters indicative of engine speed and engine load (or desired engine torque) are used to determine whether auto-ignition combustion or spark-ignition combustion are required. Spark-ignition combustion takes place when auto-ignition combustion is not required. In FIG. 16, a horizontal line segment drawn above 50% of torque and a vertical line segment connected to the horizontal line segment illustrate engine load threshold and engine speed threshold, respectively. The engine load threshold represented by the horizontal line segment is often referred to as a knock limit. If the auto-ignition combustion is carried out with the values of engine load exceeding this knock limit, the frequency of knock events exceeds an acceptable level. FIG. 14 also illustrates the neighboring zone to the knock limit. If the percentage load of 50% is exceeded, it is determined that the engine operation has entered the neighboring zone to the knock limit.

Figure 26:
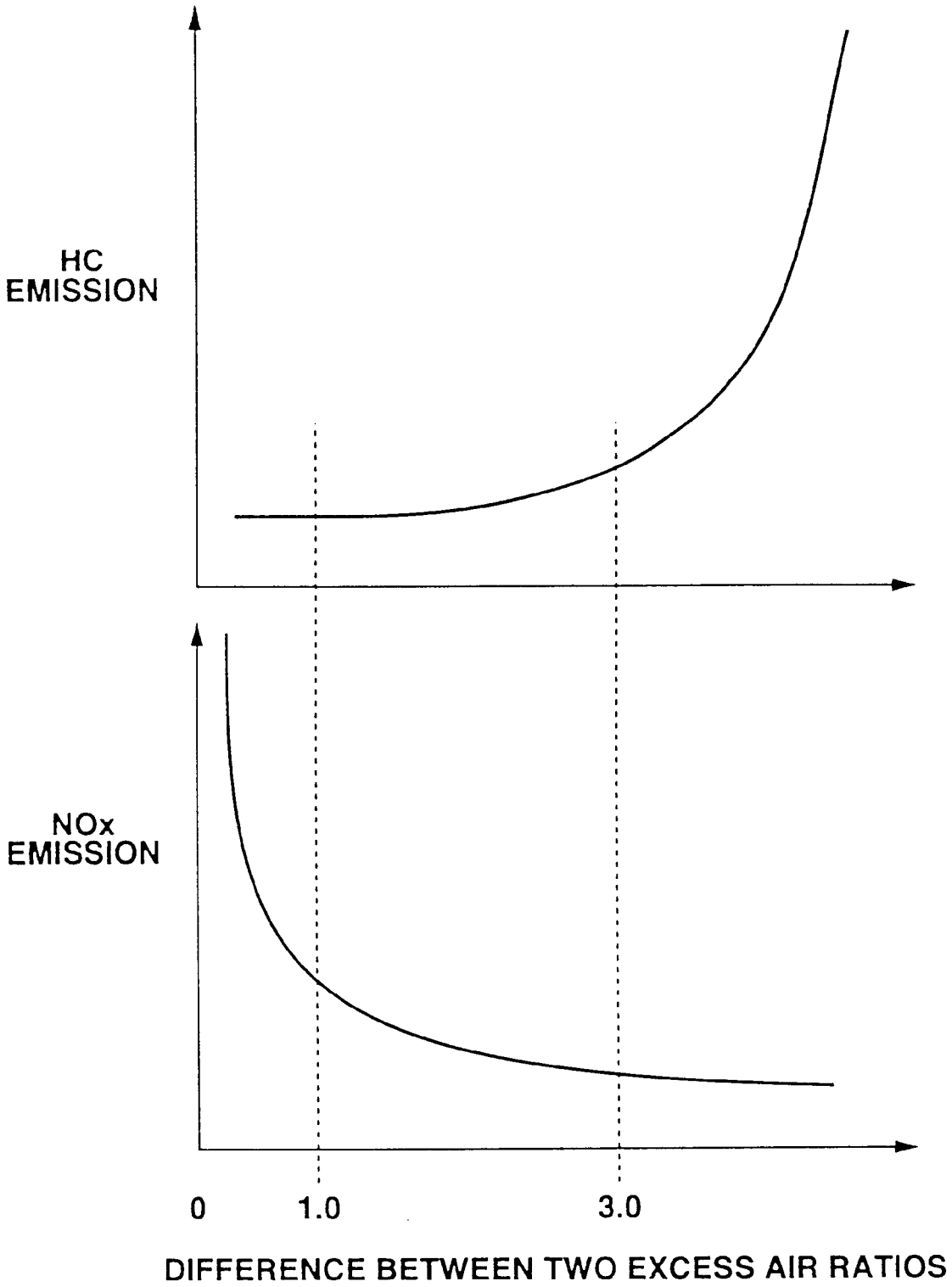
FIG. 26 illustrates variations of HC and NOx emissions against variation of a difference between an excess air ratio of lean mixture portion and an excess air ratio of rich mixture portion.

Referring to FIG. 26, HC and NOx emissions are illustrated against varying values of a difference between an excess air ratio of the superimposed portion 7 and an excess air ratio of the remaining portion of the circular solid body 6. If this difference is excessively small, the speed at which combustion flame propagates increases to provide rapid burn of fuel particles. This causes an increase in combustion temperature, causing an increase in NOx emission. If this difference is excessively big, fuel particles in the vicinity of the cylinder axis 104 and fuel particles in the vicinity of the cylinder inner wall fail to burn completely, resulting in an increase in HC emission. Preferably, the difference ranges from 1.0 to 3.0 for suppressing both NOx and HC emissions.

Referring to FIGS. 17 to 26, another embodiment of the present invention is illustrated. This embodiment is substantially the same as the previously described embodiment. FIGS. 17, 18–19, and 24–25 correspond to FIGS. 1, 9–10, and 13–14. Comparing FIG. 17 with FIG. 1 clearly reveals that the cylinder content established according to this embodiment is distinct from the cylinder content established according to the previous embodiment. There is a difference in the structure of a spout of a nozzle of fuel injector 18, however. The spout structure employed by the this embodiment will not apply torque to fuel passing through the: spout so that the fuel particles sprayed by the fuel injector 18 will not widely spread outwardly. The split injection control according to this embodiment is different from the previous embodiment as will be readily understood from comparing FIGS. 24 and 25 with FIGS. 13 and 14.

Figure 18:
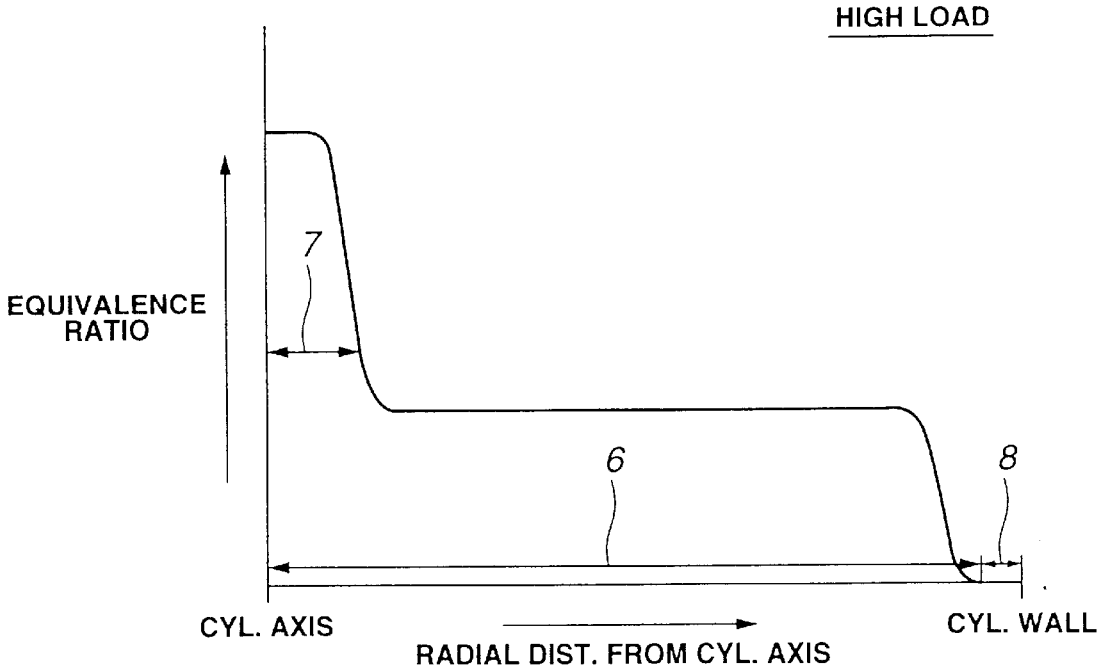
FIG. 18 illustrates graphically the cylinder content during high load operation in auto-ignition combustion mode at a crank position of the piston in the neighborhood of TDC position of compression stroke.

FIG. 18 graphically. illustrates the cylinder content during high load operation. The cylinder content includes superimposed portion 7 having a great equivalence ratio, the remaining portion of solid circular body 6 having a less great equivalence ratio, and an outer layer 8 containing air. The density of fuel particles of superimposed portion 7 is high enough to accomplish auto-ignition. The superimposed portion 7 is located in the vicinity of cylinder axis 104 and surrounded by the remaining portion of solid circular body 6. The outer layer 8 surrounds the solid circular body 6 and extends to cover the cylinder inner wall.

Referring also to FIGS. 24 and 25, the remaining portion of the solid circular body 6 is populated by fuel particles of first fuel injection. During high load operation, injection timing of the first fuel injection falls in a range from the initiation of intake stroke to the termination of the first half of compression stroke. The superimposed portion 7 is populated by fuel particles of first fuel injection and fuel particles of second fuel injection. Injection timing of second fuel injection falls in the second half of compression stroke. For providing outer air layer 8, the injection timing of the first fuel injection should falls in a range from the initiation of the second half of intake stroke to the termination of the first half of compression stroke.

Figure 19:
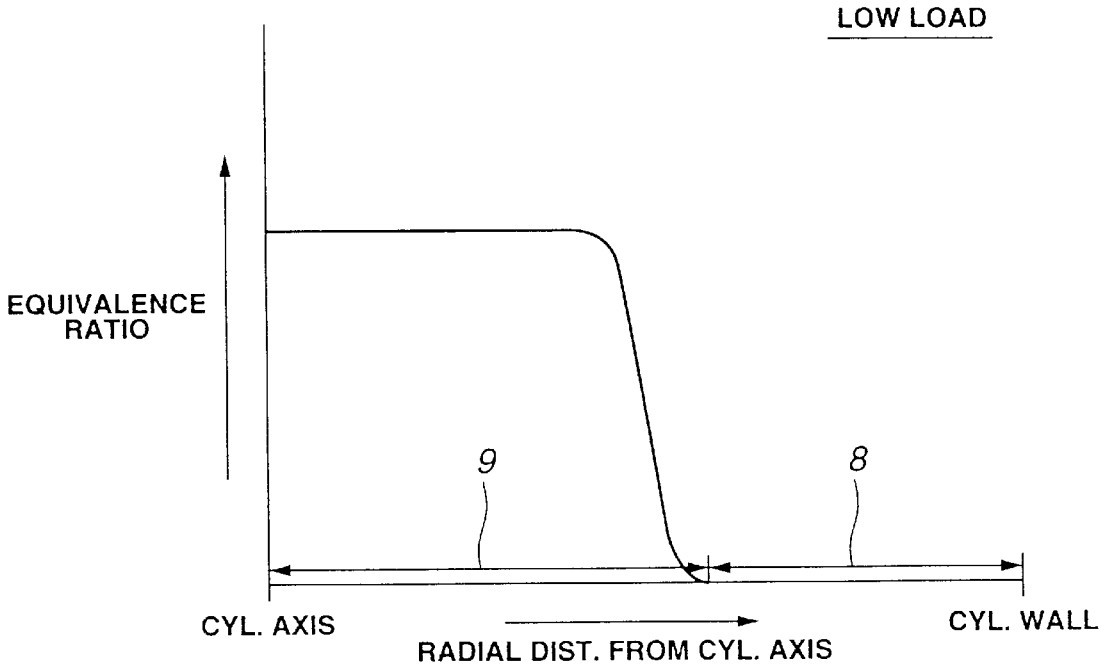
FIG. 19 illustrates graphically the cylinder content during low load operation in auto-ignition combustion mode at the crank position of the piston in the neighborhood of TDC position of compression stroke.

FIG. 19 graphically illustrates the cylinder content during low load operation. Referring also to FIGS. 24 and 25, during low load operation, the first fuel injection only is effected at injection timing near the injection timing of the second fuel injection. Accordingly, a circular solid body of mixture 9 is formed in the vicinity of the cylinder axis 104. The circular body of mixture 9 extends outwardly from the cylinder axis 104 as far as half (½) of the radius of cylinder bore. An outer layer 8, which contains air, surrounds the circular body of mixture 9 and extends to cover the inner wall of cylinder. The equivalence ratio of the body of mixture 9 has an equivalence ratio that is greater than the equivalence ratio of the remaining portion of the solid circular body 6 but slightly less than the equivalence ratio of the superimposed portion 7 during high load operation as illustrated in FIG. 18. As a result, stable auto-ignition is accomplished during low load operation. Further, fuel particles burn completely before combustion flame comes into contact with the inner wall of cylinder. As a result, HC emission is reduced below a satisfactorily low level near zero.

Figure 20:
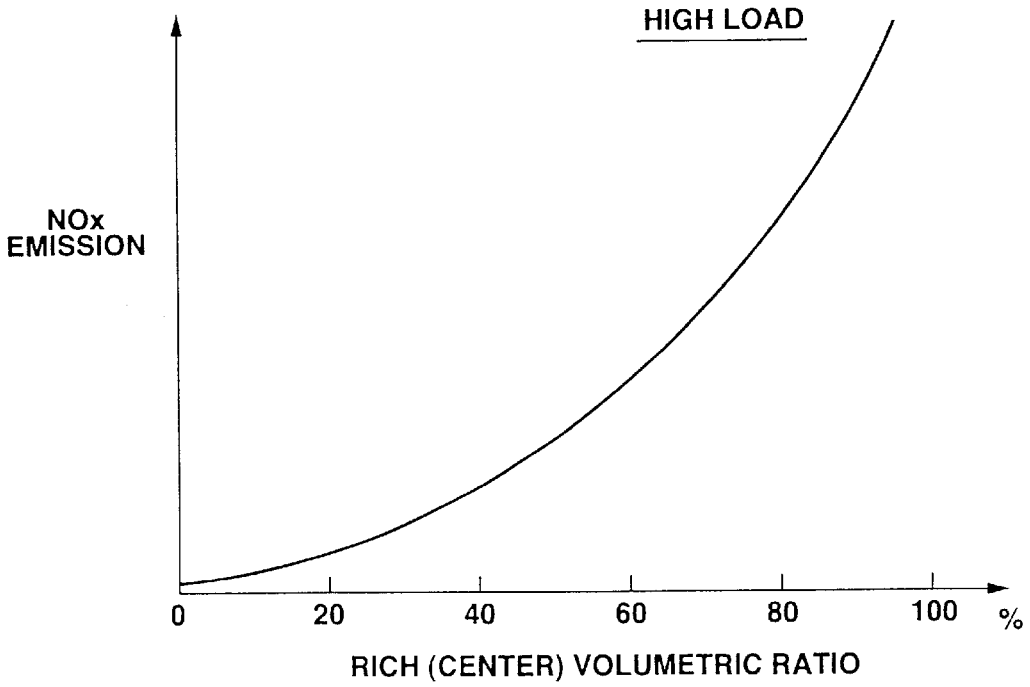
FIG. 20 illustrates graphically variation of nitrogen oxides (NOx) emission, during high load operation, against variation of a volumetric ratio of rich mixture portion populated by fuel particles sprayed at the first fuel injection and also by fuel particles sprayed at the second fuel injection.

FIG. 20 graphically illustrates NOx emission, during high load operation, against various values of a volumetric ratio of rich mixture body in the vicinity of the cylinder axis 104 to combustion chamber. The term "a rich (center) volumetric ratio" is herein used to mean the above-mentioned ratio because the body of mixture stays in the vicinity of the center of the combustion chamber and it is rich. NOx emission increases as the rich (center) volumetric ratio is increased at a gradual rate from 0% to 100%. The volume of body of mixture that has high density of fuel particles increases, causing an increase in volume of mixture body that will burn with high combustion temperature. This accounts for an increase in NOx emission if the rich volumetric ratio is increased.

Figure 21:
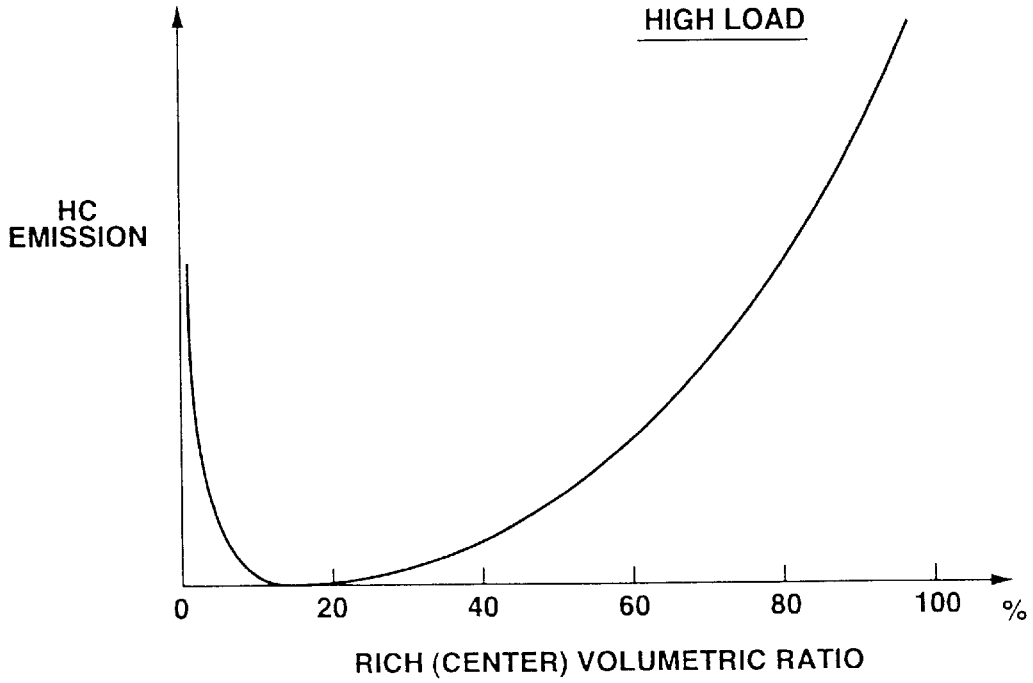
FIG. 21 illustrates graphically variation of hydrocarbon (HC) emission, during high load operation, against variation of the volumetric ratio of rich mixture portion populated by fuel particles sprayed at the first fuel injection and also by fuel particles sprayed at the second injection timing.

FIG. 21 graphically illustrates HC emission, during high load operation, against various values of the rich (center) volumetric ratio. If the volumetric ratio is near 0%, there is no body of ignitable mixture in the vicinity of the cylinder axis 104, causing considerable amount of HC emission. The volume of ignitable mixture in the vicinity of the cylinder axis increases against increase in the rich (center) volumetric ratio, improving the ignition capability. HC emission drops down below a satisfactorily low level near zero as the rich (center) volumetric ratio increases to 10%. HC emission stays below this satisfactorily low level until the rich (center) volumetric ratio exceeds 20%. If the rich (center) volumetric ratio exceeds 20%. HC emission increases as the rich (center) volumetric ratio increases. As the rich (center) volumetric ratio approaches 100%, HC emission increases at an increasing rate.

Increasing the rich (center) volumetric ratio results in formation of quenching layer resulting from contact of the fuel particles with the cylinder inner wall because the fuel particles of body of mixture disperse outwardly. This accounts for increasing of HC emission at increasing rate.

From preceding description in connection with FIGS. 20 and 21, it is preferred that the volume of superimposed portion 7 ranges from 10% to 30% of the volume of combustion chamber during high load operation.

Figure 22:
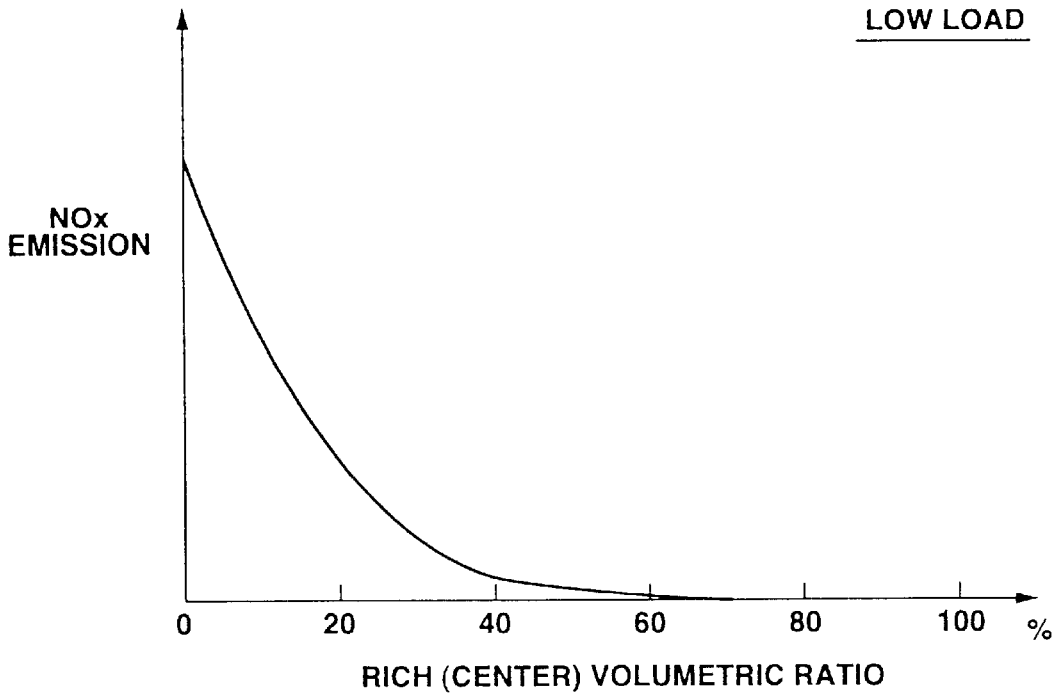
FIG. 22 illustrates graphically variation of nitrogen oxides (NOx) emission, during low load operation, against variation of the volumetric ratio of rich mixture portion populated by fuel particles sprayed at the first fuel injection and also by fuel particles sprayed at the second fuel injection.

FIG. 22 graphically illustrates NOx emission, during low load operation, against varying values of the rich (center) volumetric ratio from 0% to 100%. Increasing the rich (center) volumetric ratio from 0% to 50% causes HC emission to decrease. NOx emission drops below a satisfactorily low level near zero at around 50% of the rich (center) volumetric ratio. From 50% to 100%, NOx emission is almost zero.

Figure 23:
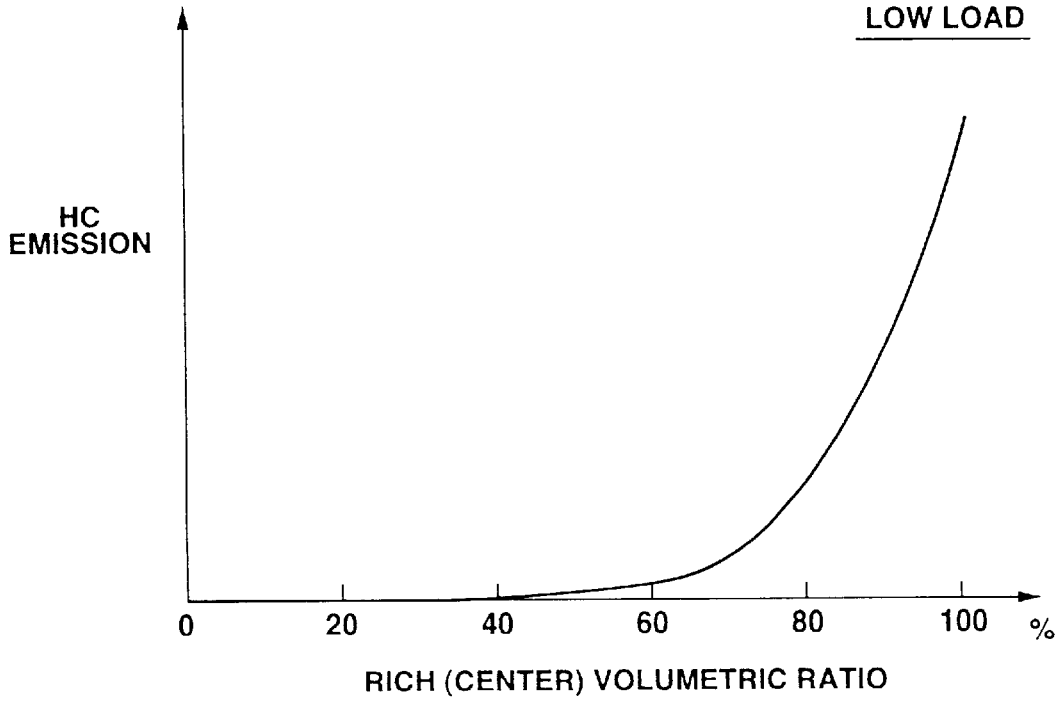
FIG. 23 illustrates graphically variation of hydrocarbon (HC) emission, during low load operation, against variation of the volumetric ratio of rich mixture portion populated by fuel particles sprayed at the first fuel injection and also by fuel particles sprayed at the second injection.

FIG. 23 graphically illustrates HC emission, during low load operation, against varying values of the rich (center) volumetric ratio from 0% to 100%. HC emission stays below a satisfactorily low level near zero against varying values of rich (center) volumetric ratio from 0% to 50%. If 50% is exceeded, HC emission increases at a slow rate until 70% and thereafter increases at an increasing rate. Increasing the rich (center) volumetric ratio results in formation of quenching layer resulting from contact of the fuel particles with the cylinder inner wall because the fuel particles of body of mixture disperse outwardly. This accounts for increasing of HC emission at increasing rate.

From preceding description in connection with FIGS. 22 and 23, it is preferred that the volume of superimposed portion 7 is held blow a satisfactorily low level or the first fuel injection only is effected during low load operation for holding NOx and HC emissions below a satisfactorily low level.

Referring to FIG. 24, during high load operation, it is preferred that injection quantity of the first fuel injection ranges from 60% to 80% of the total fuel quantity. Injection quantity of the second fuel injection corresponds to the remainder of the total fuel quantity. Thus, injection quantity of the second fuel injection ranges from 40% to 20% of the total fuel quantity.

As the engine load decreases from high load to low load, injection quantity of the second fuel injection decreases. During high load operation, a difference between an excess air ratio of mixture of the superimposed portion and an excess air ratio of mixture of the remaining portion of solid circular body 6 ranges from 0.5 to 1.0. This difference drops as the engine load decreases.

Referring to FIG. 25, injection timing of second fuel injection is at a crank position falling in the second half of the piston TDC position, while injection timing of first fuel injection is at a crank position in the neighborhood of and after piston bottom dead center (BDC) position during high load operation. Injection timing of first fuel injection is delayed as engine load decreases toward a crank position immediately before the injection timing of second fuel injection. Preferably, the injection timing is delayed to a crank position 60 degrees before piston TDC of compression stroke.

Referring to FIG. 26, HC and NOx emissions are illustrated against varying values of a difference between an excess air ratio of the superimposed portion 7 and an excess air ratio of the remaining portion of the circular solid body 6. If this difference is excessively small, the speed at which combustion flame propagates increases to provide rapid burn of fuel particles. This causes an increase in combustion temperature, causing an increase in NOx emission. If this difference is excessively big, fuel particles in the vicinity of the cylinder axis 104 and fuel particles in the vicinity of the cylinder inner wall fail to burn completely, resulting in an increase in HC emission. Preferably, the difference ranges from 1.0 to 3.0 for suppressing both NOx and HC emissions.

While the present invention has been particularly described, in conjunction with preferred embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

This application claims the priority of Japanese Patent Applications No. 2000-018898, filed Jan. 27, 2000, and No. 2000-018856, filed Jan. 27, 2000, the disclosure of each of which is hereby incorporated by reference in its entirety.

What is claimed is:

1. A gasoline internal combustion engine, comprising:

a cylinder;

a reciprocating piston disposed in said cylinder to define a combustion chamber therein to perform an intake stroke, a compression stroke, an expansion stroke, and an exhaust stroke; and a fuel injector directly communicating with said combustion chamber for spraying gasoline fuel, a control arrangement being such that said fuel injector sprays a first injection quantity of gasoline fuel into said combustion chamber at first fuel injection timing, which falls in a range from the intake stroke to the first half of the compression stroke, thereby to form air/fuel mixture cloud that becomes a body of mixture as said piston moves from said first fuel injection timing toward a top dead center position of the compression stroke, and such that said fuel injector sprays a second injection quantity of gasoline fuel into said body of mixture at second fuel injection timing, which falls in the second half of the compression stroke, forming mixture cloud that is superimposed on a portion of said body of mixture, thereby to establish the cylinder content wherein the density of fuel particles within said superimposed portion is high enough to burn by auto-ignition at an ignition point in the neighborhood of the piston top dead center position of the compression stroke, causing temperature rise and pressure, which initiate auto-ignition of the fuel particles within the remaining portion of said body of mixture.

2. The gasoline internal combustion engine as claimed in claim 1, wherein a total fuel injection quantity is divided into said first and second injection quantities, and said second injection quantity is less than said first injection quantity during high load engine operation.

3. The gasoline internal combustion engine as claimed in claim 2, wherein said superimposed portion of said body of mixture stays in the vicinity of a cylinder axis of said cylinder and surrounded by said remaining portion thereof.

4. The gasoline internal combustion engine as claimed in claim 3, wherein auto-ignition causes gasoline fuel to burn for auto-ignition combustion, and said second injection quantity is held lower than 40% of said total fuel injection quantity when the engine load is in the neighborhood of engine load threshold corresponding to an knock limit of the auto-ignition combustion.

5. The gasoline internal combustion engine as claimed in claim 2, wherein said second injection timing is so selected as to initiate auto-ignition of fuel particles within said remaining portion of said body of mixture at a crank position of said piston after the piston top dead center position of compression stroke.

6. The gasoline internal combustion engine as claimed in claim 3, wherein said body of mixture is surrounded by an outer layer that extends along to cover an inner wall of said cylinder, said outer layer containing air.

7. The gasoline internal combustion engine as claimed in claim 2, wherein said remaining portion of said body of mixture stays in the vicinity of a cylinder axis of said cylinder and said superimposed portion thereof stays in spaced relationship from said cylinder axis.

8. The gasoline internal combustion engine as claimed in claim 7, wherein said body of mixture is surrounded by an outer layer that extends along to cover an inner wall of said cylinder, said outer layer containing air.

9. A system for enhanced auto-ignition management in an internal combustion engine, comprising:

a cylinder having a cylinder axis thereof;

a cylinder head closing said cylinder;

a reciprocating piston within said cylinder, said piston, said cylinder and said cylinder head cooperating with each other to define a combustion chamber;

intake and exhaust valves for admitting fresh air into said combustion chamber and for discharging exhaust gas from said combustion chamber, respectively;

a fuel injector mounted to said cylinder head for spraying gasoline fuel into said combustion chamber, said fuel injector having a hollow cone nozzle with a spout communicating with said combustion chamber, said hollow cone nozzle imparting torque to gasoline fuel passing through said spout, causing the fuel to generate swirl around a nozzle axis, promoting the fuel to spread outwardly along a cone surface of an imaginary circular cone, said imaginary circular cone being a solid cone bounded by a region enclosed in a circle and a cone surface that is formed by the segments joining each point on said circle to a point outside of said region and on said nozzle axis within said spout;

said piston moving along said cylinder axis toward and away from said cylinder head to perform an intake stroke, a compression stroke, an expansion stroke, and an exhaust stroke in cooperation with said intake and exhaust valves; and a control unit being operative to establish an engine load threshold and an engine speed threshold;

said control unit being operative to compare the engine load with said engine load threshold, said control unit being operative to compare the engine speed with said engine speed threshold, said control unit being operative to enable split fuel injection for auto-ignition combustion in response to the comparing result of the engine load with said engine load threshold and the comparing result of the engine speed with said engine speed threshold, said control unit being operative to determine a ratio in response to the engine load, said control unit being operative to determine total fuel injection quantity in response to the engine load, said control unit being operative to divide said total fuel injection quantity at said determined ratio into injection quantity for first fuel injection and into injection quantity for second fuel injection, said control unit being operative to determine a first injection timing that falls in a range from the intake stroke to the termination of the first half of compression stroke, said control unit being operative to determine a second injection timing that falls in the second half of the compression stroke, said control unit being operative to determine a first pulse width corresponding to the injection quantity for the first fuel injection and a second pulse width corresponding to the injection quantity for the second fuel injection, said control unit being operative to apply a first fuel injection control signal with said first pulse width, at said first injection timing, to said fuel injector, causing said fuel injector to spray said first injection quantity of gasoline fuel into said combustion chamber, thereby to form a conical ring shaped air/fuel mixture cloud that becomes a circular solid body of mixture as said piston moves from said first injection timing toward a top dead center position of the compression stroke, said control unit being operative to apply a second fuel injection control signal with said second pulse width, at said second injection timing, to said fuel injector, causing said fuel injector to spray said second injection quantity of gasoline fuel into said circular solid body of mixture, thereby to form, within said circular solid body of mixture, a ring shaped mixture cloud that is superimposed on a portion of said circular solid body of mixture, thereby to establish the cylinder content wherein the density of fuel particles within said superimposed portion is high enough to burn by auto-ignition at an ignition point in the neighborhood of the piston top dead center position of the compression stroke, causing temperature rise and pressure rise, which initiate auto-ignition of the fuel particles within the remaining portion of said circular body of mixture.

10. The system as claimed in claim 9, wherein said control unit is operative, during selection of auto-ignition combustion mode, to suppress said second injection quantity less than 40% of said total fuel injection quantity when said engine load exceeds a predetermined load value that stays in the proximity of said knock limit.

11. The system as claimed in claim 9, wherein said control unit is operative, during selection of auto-ignition combustion mode, to determine said first and second injection quantities such that a ratio of said second injection quantity to said total fuel injection quantity increases as said engine load decreases.

12. The system as claimed in claim 11, wherein, during selection of auto-ignition combustion mode, said control unit is operative to establish the cylinder content state wherein a volumetric ratio of volume of said remaining portion of said circular solid body of mixture to volume of said combustion chamber falls in a range from 20% to 40%, and wherein said circular solid body of mixture is surrounded by an outer layer that extends along to cover inner wall of said cylinder.

13. The system as claimed in claim 12, wherein, during selection of auto-ignition combustion mode, said control unit is operative to establish the cylinder content state wherein a difference between an excess air ratio of said remaining portion of said circular solid body of mixture and an excess air ratio of said superimposed portion of said circular body of mixture falls in a range from 1.0 to 3.0.

14. A system for enhanced auto-ignition management in an internal combustion engine, comprising:

a cylinder having a cylinder axis thereof;

a cylinder head closing said cylinder;

a reciprocating piston within said cylinder, said piston, said cylinder and said cylinder head cooperating with each other to define a combustion chamber;

intake and exhaust valves for admitting fresh air into said combustion chamber and for discharging exhaust gas from said combustion chamber, respectively;

a fuel injector mounted to said cylinder head and having a nozzle with a spout communicating with said combustion chamber for spraying gasoline fuel into said combustion chamber;

said piston moving along said cylinder axis toward and away from said cylinder head to perform an intake stroke, a compression stroke, an expansion stroke, and an exhaust stroke in cooperation with said intake and exhaust valves; and a control unit being operative to establish an engine load threshold and an engine speed threshold;

said control unit being operative to compare the engine load with said engine load threshold, said control unit being operative to compare the engine speed with said engine speed threshold, said control unit being operative to enable split fuel injection for auto-ignition combustion in response to the comparing result of the engine load with said engine load threshold and the comparing result of the engine speed with said engine speed threshold, said control unit being operative to determine a ratio in response to the engine load, said control unit being operative to determine total fuel injection quantity in response to the engine load, said control unit being operative to divide said total fuel injection quantity at said determined ratio into injection quantity for first fuel injection and into injection quantity for second fuel injection, said control unit being operative to determine a first injection timing in response to said engine load such that said first injection timing retards in a direction from the bottom dead center position of the compression stroke to the top dead center position of the compression stroke as the engine load decreases, said control unit being operative to determine a second injection timing that falls in the second half of the compression stroke, said second injection timing being always nearer the top dead center position of the compression stroke than said first injection timing, said control unit being operative to determine a first pulse width corresponding to the injection quantity for the first fuel injection and a second pulse width corresponding to the injection quantity for the second fuel injection, said control unit being operative to apply a first fuel injection control signal with said first pulse width, at said first injection timing, to said fuel injector, causing said fuel injector to spray said first injection quantity of gasoline fuel into said combustion chamber, thereby to form an air/fuel mixture cloud that becomes a solid body of mixture in the vicinity of said cylinder axis as said piston moves from said first injection timing toward the top dead center position of the compression stroke, said control unit being operative to apply a second fuel injection control signal with said pulse width, at said second injection timing, to said fuel injector, causing said fuel injector to spray said second injection quantity of gasoline fuel into said solid body of mixture, forming, within said solid body of mixture, a mixture cloud that is superimposed on a portion of said solid body of mixture, thereby to establish the cylinder content wherein the density of fuel particles of said superimposed portion is high enough to burn by auto-ignition at an ignition point in the neighborhood of the piston top dead center position of the compression stroke, causing temperature rise and pressure rise, which initiate auto-ignition of the fuel particles within the remaining portion of said circular body of mixture.

15. The system as claimed in claim 14, wherein said control unit is operative to suppress said second injection quantity less than 40% of said total fuel injection quantity when said engine load exceeds a predetermined load value that is less than said engine load threshold.

16. The system as claimed in claim 14, wherein, during high load operation, said control unit is operative to establish the cylinder content wherein a volumetric ratio of volume of said superimposed portion of said solid body of mixture to volume of said combustion chamber falls in a range from 10% to 30%, and wherein said solid body of mixture is surrounded by an outer layer that extends along to cover inner wall of said cylinder.

17. The system as claimed in claim 16, wherein, during low load operation, said control unit is operative to establish the cylinder content wherein said second injection quantity is at one of zero level and a predetermined level in the vicinity of zero.

18. The system as claimed in claim 17, wherein, during selection of auto-ignition combustion mode, said control unit is operative to establish the cylinder content wherein a difference between an excess air ratio of said remaining portion of said circular solid body of mixture and an excess air ratio of said superimposed portion of said circular body of mixture falls in a range from 1.0 to 3.0.

19. A method of controlling split gasoline fuel injection for enhanced auto-ignition management in an internal combustion engine, the engine having a cylinder with a cylinder axis thereof; a cylinder head closing the cylinder; a reciprocating piston within the cylinder to define a combustion chamber to perform an intake stroke, a compression stroke, an expansion stroke, and an exhaust stroke; intake and exhaust valves for admitting fresh air into the combustion chamber and for discharging exhaust gas from the combustion chamber, respectively; and a fuel injector for spraying gasoline fuel into the combustion chamber, the fuel injector having a hollow cone nozzle with a spout communicating with the combustion chamber, the hollow cone nozzle imparting torque to gasoline fuel passing through the spout, causing the fuel to generate swirl around a spout axis that aligns the cylinder axis, promoting the fuel to spread outwardly along a cone surface of an imaginary circular cone, the imaginary circular cone being a solid cone bounded by a region enclosed in a circle about the cylinder axis and a cone surface that is formed by the segments joining each point on the circle to a point outside of the region and on the nozzle axis within the spout, said method compromising:

establishing an engine load threshold;

establishing an engine speed threshold;

comparing the engine load with said engine load threshold;

comparing the engine speed with said engine speed threshold;

enabling split fuel injection for auto-ignition combustion in response to the comparing result of the engine load with said engine load threshold and the comparing result of the engine speed with said engine speed threshold;

determining a ratio in response to the engine load;

determine total fuel injection quantity in response to the engine load;

dividing said total fuel injection quantity at said determined ratio into injection quantity for first fuel injection and into injection quantity for second fuel injection, determining a first injection timing that falls in a range from the piston intake stroke to the end of the first half of the piston compression stroke;

determining a second injection timing that falls in the second half of the piston compression stroke;

determine a first pulse width corresponding to the injection quantity for the first fuel injection;

determining a second pulse width corresponding to the injection quantity for the second fuel injection;

applying a first fuel injection control signal with said first pulse width at said first injection timing to said fuel injector, causing said fuel injector to spray said first injection quantity of gasoline fuel into said combustion chamber, thereby to form a conical ring shaped air/fuel mixture cloud that becomes a circular solid body of mixture as said piston moves from said first injection timing toward a top dead center position of the compression stroke;

applying a second fuel injection control signal with said second pulse width at said second injection timing to said fuel injector, causing said fuel injector to spray said second injection quantity of gasoline fuel into said circular solid body of mixture, forming, within said circular solid body of mixture, a ring shaped mixture cloud that is superimposed on a portion of said circular solid body of mixture, thereby to establish the cylinder content wherein the density of fuel particles within said superimposed portion is high enough to burn by auto-ignition at an ignition point in the neighborhood of the piston top dead center position of the compression stroke, causing temperature rise and pressure rise, which initiate auto-ignition of the fuel particles within the remaining portion of said circular body of mixture.

20. The method as claimed in claim 19, wherein said determined ratio is a ratio of said second injection quantity to said total fuel injection quantity, and wherein said determined ratio increases as the engine load decreases.

21. The method as claimed in claim 20, further comprising:

establishing the cylinder content wherein a volumetric ratio of volume of said remaining portion of said circular solid body of mixture to volume of said combustion chamber falls in a range from 20% to 40%, and wherein said circular body of mixture is surrounded by an outer layer that extends along to cover inner wall of said cylinder.

22. The method as claimed in claim 21, further comprising:

establishing the cylinder content wherein a difference between an excess air ratio of said remaining portion of said circular solid body of mixture and an excess air ratio of said superimposed portion of said circular body of mixture falls in a range from 1.0 to 3.0.

23. A method of controlling gasoline fuel injection for enhanced auto-ignition management in an internal combustion engine, the engine having a cylinder with a cylinder axis thereof; a cylinder head closing the cylinder; a reciprocating piston within the cylinder to define a combustion chamber to perform an intake stroke, a compression stroke, an expansion stroke, and an exhaust stroke; intake and exhaust valves for admitting fresh air into the combustion chamber and for discharging exhaust gas from the combustion chamber, respectively; and a fuel injector having a nozzle with a spout communicating with the combustion chamber for spraying gasoline fuel into the combustion chamber, said method comprising:

determining a ratio in response to the engine load;

determine total fuel injection quantity in response to the engine load;

dividing said total fuel injection quantity at said determined ratio into injection quantity for first fuel injection and into injection quantity for second fuel injection;

determining a first injection timing in response to the engine load such that said first injection timing retards in a direction from the bottom dead center position of the compression stroke to the top dead center position of the compression stroke as the engine load decreases;

determining a second injection timing that falls in the second half of the compression stroke, said second injection timing being always nearer the top dead center position of the compression stroke than said first injection timing is;

determine a first pulse width corresponding to the injection quantity for the first fuel injection;

determining a second pulse width corresponding to the injection quantity for the second fuel injection;

applying a first fuel injection control signal with said first pulse width at said first injection timing to the fuel injector, causing the fuel injector to spray said first injection quantity of gasoline fuel into the combustion chamber, thereby to form an air/fuel mixture cloud that becomes a body of mixture in the vicinity of said cylinder axis as said piston moves from said first injection timing toward the top dead center position of the compression stroke, applying a second fuel injection control signal with said second pulse width at said second injection timing to the fuel injector, causing the fuel injector to spray said second injection quantity of gasoline fuel into said body of mixture, forming, within said body of mixture, a mixture cloud that is superimposed on a portion of said solid body of mixture, fuel particles sprayed at said first fuel injection timing and fuel particles sprayed at said second fuel injection timing coexisting within said superimposed portion, thereby to establish the cylinder content wherein the density of fuel particles of said superimposed portion is high enough to burn by auto-ignition at an ignition point in the neighborhood of the piston top dead center position of the compression stroke, causing temperature rise and pressure rise, which initiate auto-ignition of the fuel particles within the remaining portion of said circular body of mixture.

24. The method as claimed in claim 23, further comprising:

establishing, during high load operation, the cylinder content wherein a volumetric ratio of volume of said superimposed portion of said solid body of mixture to volume of said combustion chamber falls in a range from 10% to 30%, and wherein said solid body of mixture is surrounded by an outer layer that extends along to cover inner wall of said cylinder.

25. The method as claimed in claim 24, further comprising:

establishing, during low load operation, the cylinder content wherein said second injection quantity is at one of zero level and a predetermined level in the vicinity of zero.

26. The method as claimed in claim 25, further comprising:

establishing the cylinder content wherein a difference between an excess air ratio of said remaining portion of said circular solid body of mixture and an excess air ratio of said superimposed portion of said circular body of mixture falls in a range from 1.0 to 3.0.

27. A computer readable storage medium having stored therein data representing instructions executable by an engine control unit to control split gasoline fuel injection for enhanced auto-ignition, the computer readable storage medium comprising:

instructions for establishing an engine speed threshold;

instructions for establishing an engine load threshold;

instructions for comparing the engine speed with said engine speed threshold;

instructions for comparing the engine load with said engine load threshold;

instruction for enabling or disabling split gasoline fuel injection control;

instructions for determining a ratio in response to the engine load;

instructions for determine total fuel injection quantity in response to the engine load;

instructions for dividing said total fuel injection quantity at said determined ratio into injection quantity for first fuel injection and into injection quantity for second fuel injection;

instructions for determining injection timing for first fuel injection; and instructions for determining injection timing for second fuel injection.

* * * * *